US011830418B2

(12) United States Patent
Liu et al.

(10) Patent No.: US 11,830,418 B2
(45) Date of Patent: Nov. 28, 2023

(54) PIXEL DRIVING CIRCUIT AND DRIVING METHOD THEREOF, LIGHT-EMITTING PANEL, AND DISPLAY DEVICE

(71) Applicant: Xiamen Tianma Microelectronics Co., Ltd., Xiamen (CN)

(72) Inventors: Jian Liu, Xiamen (CN); Liu Wang, Xiamen (CN); Wei Wu, Xiamen (CN); Zhijie Wang, Xiamen (CN); Shumao Wu, Xiamen (CN); Guochang Lai, Xiamen (CN)

(73) Assignee: Xiamen Tianma Microelectronics Co., Ltd., Xiamen (CN)

( * ) Notice: Subject to any disclaimer, the term of this patent is extended or adjusted under 35 U.S.C. 154(b) by 0 days.

(21) Appl. No.: 18/076,566

(22) Filed: Dec. 7, 2022

(65) Prior Publication Data

US 2023/0096851 A1 Mar. 30, 2023

(30) Foreign Application Priority Data

Jun. 30, 2022 (CN) ..... 202210772995.8

(51) Int. Cl.
*G09G 3/32* (2016.01)

(52) U.S. Cl.
CPC ..... *G09G 3/32* (2013.01); *G09G 2300/0842* (2013.01); *G09G 2310/0267* (2013.01); *G09G 2310/0275* (2013.01); *G09G 2310/0286* (2013.01); *G09G 2310/061* (2013.01); *G09G 2320/0233* (2013.01); *G09G 2320/0247* (2013.01)

(58) Field of Classification Search
CPC ..... G09G 3/32–3291; G09G 2300/08; G09G 2300/0804–0819; G09G 2300/0842; G09G 2310/0243; G09G 2310/0251; G09G 2310/0267; G09G 2310/0275; G09G 2310/0286; G09G 2310/06; G09G 2310/08; G09G 2320/0204; G09G 2320/0233; G09G 2320/0247; G09G 2320/0257
See application file for complete search history.

(56) References Cited

U.S. PATENT DOCUMENTS

2017/0270860 A1* 9/2017 Wang ..... G09G 3/3258
2018/0033365 A1* 2/2018 Zhang ..... G09G 3/3233
(Continued)

FOREIGN PATENT DOCUMENTS

CN 111681700 A 9/2020
CN 113870790 A 12/2021

*Primary Examiner* — Nathan Danielsen
(74) *Attorney, Agent, or Firm* — KDW Firm PLLC

(57) ABSTRACT

Provided is a pixel driving circuit. The pixel driving circuit includes a reset unit, a storage unit, an initialization unit, a drive unit, a threshold compensation unit, and a data write unit. A first terminal of the reset unit is configured to input the signal output by a reset power supply. A second terminal of the reset unit is connected to the control terminal of the drive unit and configured to provide the reset power supply for the control terminal of the drive unit during a power-on period. During the power-on period of the pixel driving circuit, the reset unit provides the reset power supply for the drive unit and performs reset control on the drive unit, so that the drive unit is prevented from being abnormally turned on during a power-on stage, thereby avoiding a screen flicker phenomenon.

20 Claims, 24 Drawing Sheets

(56) References Cited

U.S. PATENT DOCUMENTS

| | | | | |
|---|---|---|---|---|
| 2020/0090591 | A1* | 3/2020 | Wang | G09G 3/3233 |
| 2022/0020330 | A1* | 1/2022 | Cao | G09G 3/3258 |
| 2022/0051621 | A1* | 2/2022 | Feng | G09G 3/3233 |
| 2023/0066949 | A1* | 3/2023 | Jeong | G09G 3/32 |

* cited by examiner

PIXEL DRIVING CIRCUIT AND DRIVING METHOD THEREOF, LIGHT-EMITTING PANEL, AND DISPLAY DEVICE

CROSS-REFERENCE TO RELATED APPLICATION(S)

This application claims priority to Chinese Patent Application No. 202210772995.8 filed Jun. 30, 2022, the disclosure of which is incorporated herein by reference in its entirety.

TECHNICAL FIELD

The present disclosure relates to the field of display technology and, in particular, to a pixel driving circuit and a driving method thereof, a light-emitting panel, and a display device.

BACKGROUND

With the development of display technology, the application of display panels is becoming more and more widespread. For example, display panels are applied to products such as mobile phones, computers, tablet computers, electronic books, and information inquiry machines and also can be applied to instrument displays (such as an in-vehicle display) and smart home control panels.

A micro light-emitting diode in a micro light-emitting diode display panel is a current-driven element, and a pixel driving circuit is required to provide a drive current to make the micro light-emitting diode emit light. However, during the overall power-on period of the existing pixel driving circuit, due to the current leakage phenomenon of a transistor in the pixel driving circuit, a drive transistor in the pixel driving circuit is abnormally turned on. As a result, the display effect of a display panel is seriously affected.

SUMMARY

An embodiment of the present disclosure provides a pixel driving circuit and a driving method thereof, a light-emitting panel, and a display device to avoid a screen flicker phenomenon during the power-on stage of the pixel driving circuit and to prevent the display effect from being affected.

In a first aspect, an embodiment of the present disclosure provides a pixel driving circuit. The pixel driving circuit includes a reset unit, a storage unit, an initialization unit, a drive unit, a threshold compensation unit, and a data write unit.

A first terminal of the drive unit is configured to input the signal output by a first power supply. A second terminal of the drive unit is configured to provide a light-emitting drive signal for a light-emitting unit. The storage unit is connected between the control terminal of the drive unit and the first terminal of the drive unit. The threshold compensation unit is connected between the control terminal of the drive unit and the second terminal of the drive unit.

The data write unit is connected to the first terminal of the drive unit and configured to transmit a data voltage to the drive unit. The initialization unit is connected to the control terminal of the drive unit and a first terminal of the light-emitting unit and configured to transmit a corresponding initialization voltage to the control terminal of the drive unit and the first terminal of the light-emitting unit.

A first terminal of the reset unit is configured to input the signal output by a reset power supply. The second terminal of the reset unit is connected to the control terminal of the drive unit and configured to provide the reset power supply for the control terminal of the drive unit during a power-on period.

In a second aspect, an embodiment of the present disclosure provides a driving method of a pixel circuit. The method is applied by the pixel circuit described in any one of the first aspect. The method includes the steps below.

In a power-on reset stage, the reset unit is controlled to transmit the reset power supply to the control terminal of the drive unit.

In an initialization sub-stage in a scan time period, the initialization unit is controlled to transmit the corresponding initialization voltage to the control terminal of the drive unit and the first terminal of the light-emitting unit.

In a data write stage in the scan time period, the threshold compensation unit is controlled to write the threshold voltage of the drive unit to the control terminal of the drive unit, and the data write unit is controlled to write the data voltage to the control terminal of the drive unit.

In a light emission stage in the scan time period, the first power supply, the drive unit, the light-emitting unit, and a second power supply are controlled to form a path, and the light-emitting unit is driven to emit light.

In a third aspect, an embodiment of the present disclosure provides a light-emitting panel. The panel includes the pixel driving circuit described in any one of the first aspect.

In a fourth aspect, an embodiment of the present disclosure provides a display device. The device includes the light-emitting panel described in the third aspect.

DETAILED DESCRIPTION

Figure 1:
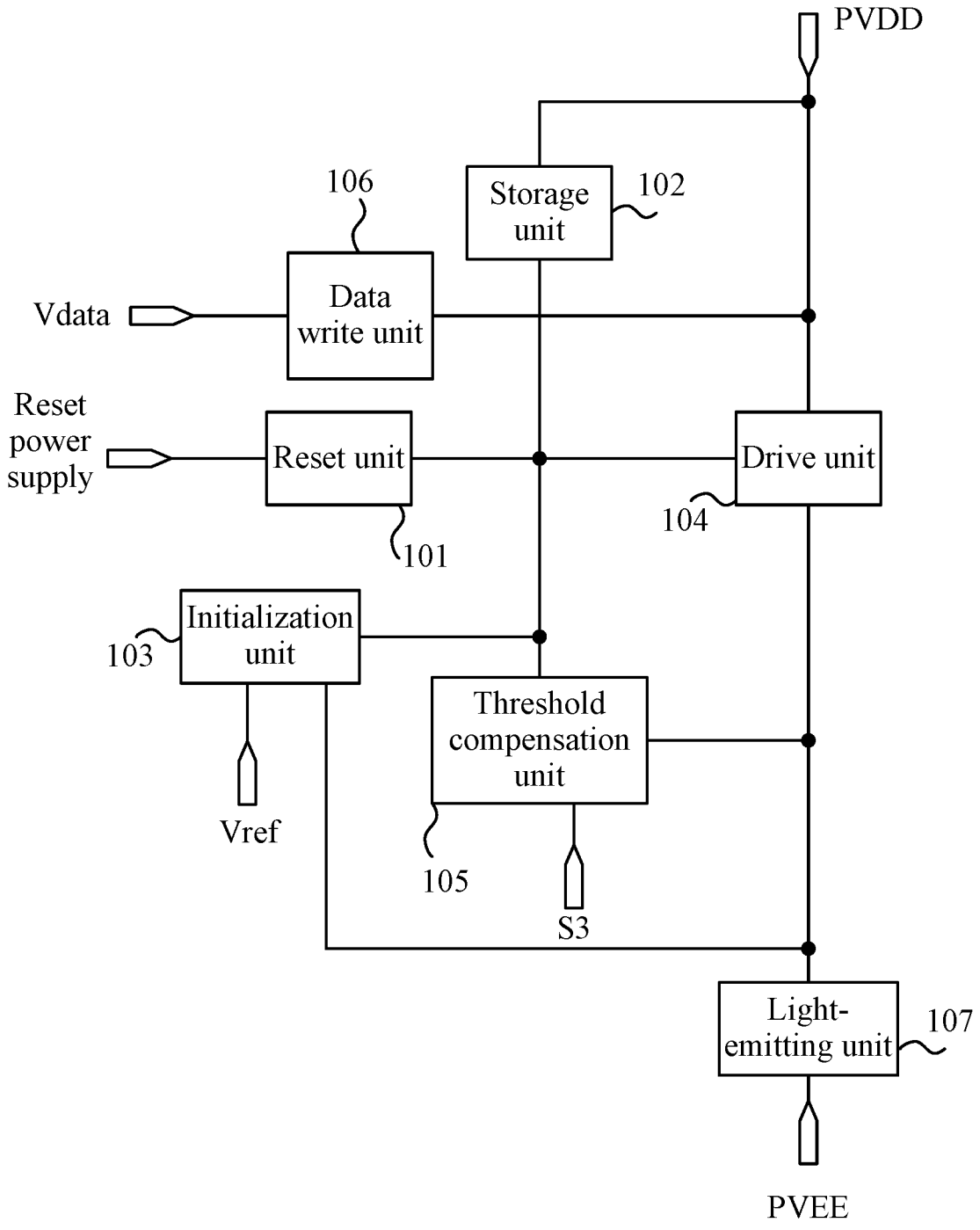
FIG. 1 is a diagram illustrating the structure of a pixel driving circuit according to an embodiment of the present disclosure.

The solutions in embodiments of the present disclosure will be described clearly and completely in conjunction with the drawings in the embodiments of the present disclosure from which the solutions will be better understood by those skilled in the art. Apparently, the embodiments described below are part, not all, of the embodiments of the present disclosure. Based on the embodiments described herein, all other embodiments obtained by those skilled in the art on the premise that no creative work is done are within the scope of the present disclosure.

In the related art, in a conventional 7T1C pixel driving circuit, for example, each transistor is a p-type transistor. During the power-on reset stage of the pixel driving circuit, a light emission control signal is always at a low level, so that a light emission control unit connected to the light emission control signal is in an on state. At the same time, due to the influence of the leakage current of an initialization unit, the control terminal of a drive unit receives a low level, so that the drive unit is turned on. Then a path is formed between a first power supply, the light emission control unit, the drive unit, a light-emitting unit, and a second power supply. In this manner, the light-emitting unit is lighted in the power-on reset stage, resulting in the abnormal display of a display panel in a non-display stage.

To solve the preceding technical problems, an embodiment of the present disclosure provides a pixel driving circuit. The pixel driving circuit includes a reset unit, a storage unit, an initialization unit, a drive unit, a threshold compensation unit, and a data write unit. A first terminal of the drive unit is configured to input the signal output by a first power supply. A second terminal of the drive unit is configured to provide a light-emitting drive signal for a light-emitting unit. The storage unit is connected between the control terminal of the drive unit and the first terminal of the drive unit. The threshold compensation unit is connected between the control terminal of the drive unit and the second terminal of the drive unit. The data write unit is connected to the first terminal of the drive unit and configured to transmit a data voltage to the drive unit. The initialization unit is connected to the control terminal of the drive unit and a first terminal of the light-emitting unit and configured to transmit a corresponding initialization voltage to the control terminal of the drive unit and the first terminal of the light-emitting unit. A first terminal of the reset unit is configured to input the signal output by a reset power supply. A second terminal of the reset unit is connected to the control terminal of the drive unit and configured to provide the reset power supply for the control terminal of the drive unit during a power-on period. In a power-on reset stage, the reset unit provides the reset power supply for the drive unit and performs reset control on the drive unit, so that the drive unit is prevented from being abnormally turned on during a power-on stage, thereby avoiding a screen flicker phenomenon.

The above is the core concept of the present disclosure, and the technical solutions in the embodiments of the present disclosure are described clearly and completely hereinafter in conjunction with the drawings in the embodiments of the present disclosure. Based on embodiments of the present disclosure, all other embodiments obtained by those of ordinary skill in the art without creative work are within the scope of the present disclosure.

FIG. 1 is a diagram illustrating the structure of a pixel driving circuit according to an embodiment of the present disclosure. As shown in FIG. 1, the pixel driving circuit includes a reset unit 101, a storage unit 102, an initialization unit 103, a drive unit 104, a threshold compensation unit 105, and a data write unit 106. The first terminal of the drive unit 104 is configured to input the signal output by the first power supply PVDD. The second terminal of the drive unit 104 is configured to provide the light-emitting drive signal for the light-emitting unit 107. The storage unit 102 is connected between the control terminal of the drive unit 104 and the first terminal of the drive unit 104. The threshold compensation unit 105 is connected between the control terminal of the drive unit 104 and the second terminal of the drive unit 104. The data write unit 106 is connected to the first terminal of the drive unit 104 and configured to transmit the data voltage to the drive unit 104. The initialization unit 103 is connected to the control terminal of the drive unit 104 and the first terminal of the light-emitting unit 107 and configured to transmit the corresponding initialization voltage Vref to the control terminal of the drive unit 104 and the first terminal of the light-emitting unit 107. The first terminal of the reset unit 101 is configured to input the signal output by the reset power supply. The second terminal of the reset unit 101 is connected to the control terminal of the drive unit 104 and configured to provide the reset power supply for the control terminal of the drive unit 104 during the power-on period.

The light-emitting unit 107 may include at least one light-emitting element. For example, the light-emitting element may be a micro light-emitting diode. The micro light-emitting diode may be a micro LED or a mini LED. The micro light-emitting diode is a current-type device and can emit light under the action of a drive current. The drive unit 104 can generate a corresponding drive current according to a data voltage signal Vdata to drive the light-emitting unit 107 to display different grayscales. In this manner, a display panel may display a to-be-displayed image. The specific working process of the pixel driving circuit includes a power-on reset stage, an initialization stage, a data write stage, and a light emission stage. In the power-on reset stage, the reset unit 101 is turned on. The reset unit 101 transmits the signal output by the reset power supply to the control terminal of the drive unit 104 during the power-on period and then performs reset processing on the control terminal of the drive unit 104. In this manner, in the power-on reset stage, the drive unit 104 is always in an off state, thereby preventing the drive unit 104 from being abnormally turned on due to the influence of the leakage current of the initialization unit 103. In the initialization stage, the reset unit 101 is turned off. The initialization unit 103 is connected to the control terminal of the drive unit 104 and the first terminal of the light-emitting unit 107. In the initialization stage, the initialization unit 103 is turned on. The initialization unit 103 outputs the initialization voltage Vref to the control terminal of the drive unit 104 and the control terminal of the light-emitting unit 107 respectively and then initializes the control terminal of the drive unit 104 and the control terminal of the light-emitting unit 107. In this manner, the residual charge of the image of the previous frame may be cleared, thereby improving the display effect of the display panel. In the data write stage, the reset unit 101 and the initialization unit 103 are turned off, and the data write unit 106 and the threshold compensation unit 105 are turned on. The data write unit 106 is connected to the first terminal of the drive unit 104. The data write unit 106 writes the data voltage signal Vdata to the drive unit 104. The threshold compensation unit 105 is connected between the control terminal of the drive unit 104 and the second terminal of the drive unit 104. The threshold compensation unit 105 may capture the threshold voltage of the drive unit 104 and write the threshold voltage to the control terminal of the drive unit 104, thereby implementing the compensation of the threshold voltage. The storage unit 102 is connected between the control terminal of the drive unit and the first terminal of the drive unit 104. The storage unit 102 may maintain the potential of the control terminal of the drive unit 104. In this manner, when the initialization unit 103 is turned off, the potential of the control terminal of the drive unit 104 is prevented from being coupled and changing. In the light emission stage, the reset unit 101, the initialization unit 103, the data write unit 106, and the threshold compensation unit 105 are each turned off, and the drive unit 104 is turned on. The second terminal of the drive unit 104 is connected to the first terminal of a light-emitting element and configured to provide the light-emitting drive signal for the light-emitting unit 107. The light-emitting unit 107 emits light in response to the light-emitting drive signal and displays to-be-displayed brightness.

In this embodiment of the present disclosure, during the power-on period, the reset unit 101 is turned on and provides the reset power supply for the control terminal of the drive unit, so that the drive unit is in the off state during the power-on period. In this manner, the drive unit is prevented from being abnormally turned on in the non-display stage, thereby preventing the light-emitting unit from being lighted. Moreover, the occurrence of the screen flicker phenomenon of the display panel is avoided, and the normal display effect of the display panel is ensured.

Figure 2:
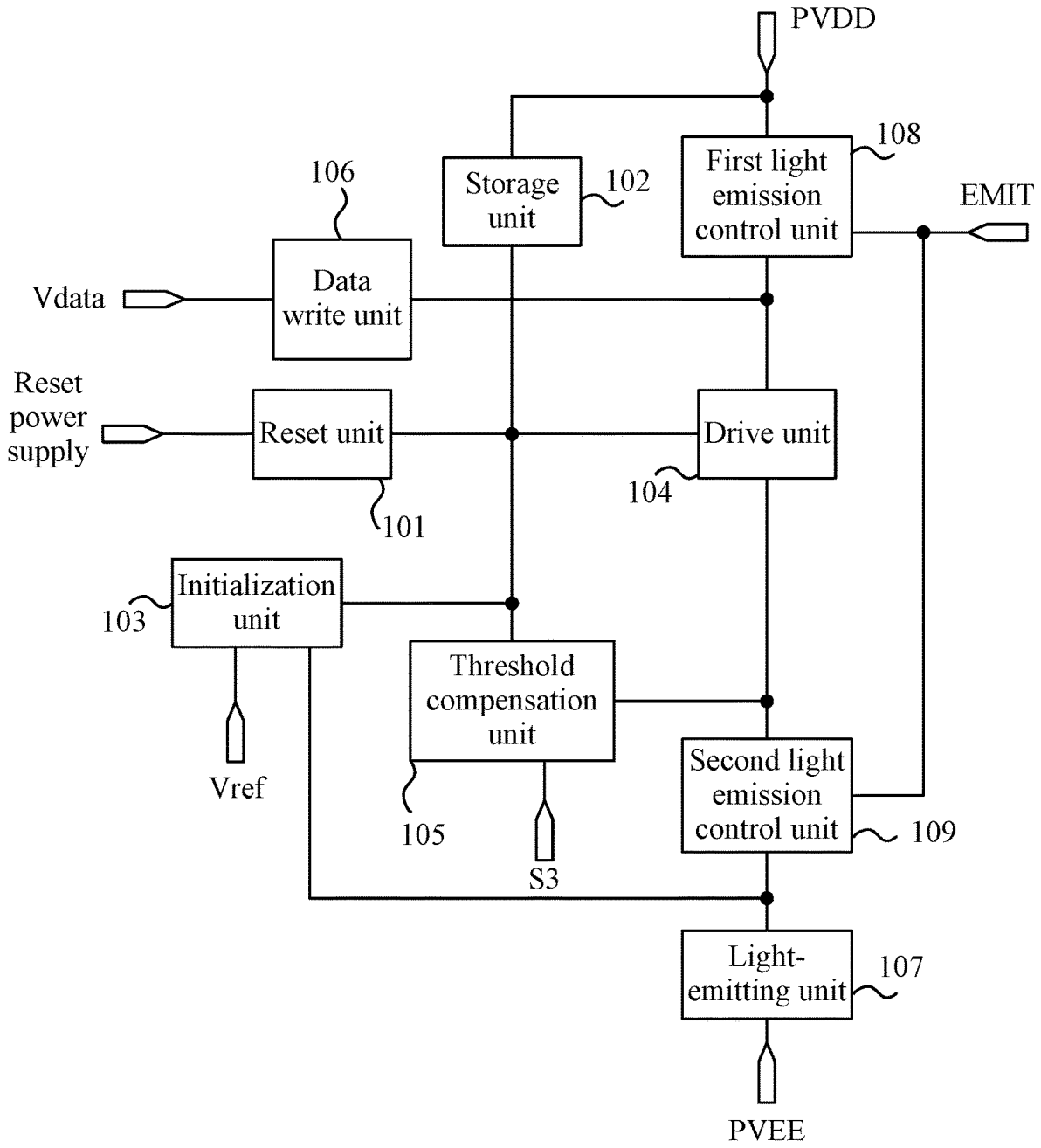
FIG. 2 is a diagram illustrating the structure of another pixel driving circuit according to an embodiment of the present disclosure.

Optionally, FIG. 2 is a diagram illustrating the structure of another pixel driving circuit according to an embodiment of the present disclosure. As shown in FIG. 2, the pixel driving circuit also includes a first light emission control unit 108 and a second light emission control unit 109. The first light emission control unit 108 is connected between the first power supply PVDD and the first terminal of the drive unit 104. The second light emission control unit 109 is connected between the second terminal of the drive unit 104 and the first terminal of the light-emitting unit 107. A second terminal of the light-emitting unit 107 is connected to the second power supply PVEE.

The pixel driving circuit also includes a first light emission control unit 108 and a second light emission control unit 109. The first light emission control unit 108 is connected between the first power supply PVDD and the first terminal of the drive unit 104. The second light emission control unit 109 is connected between the second terminal of the drive unit 104 and the first terminal of the light-emitting unit 107. The second terminal of the light-emitting unit 107 is connected to the second power supply PVEE. In the light emission stage, the first light emission control unit 108 and the second light emission control unit 109 are turned on. A voltage difference is generated between the first terminal of the drive unit 104 and the first terminal of the drive unit 104, and then the light-emitting drive signal is output to the first terminal of the light-emitting unit 107. The second terminal of the light-emitting unit 107 is connected to the second power supply PVEE. Then a path is formed between the first power supply PVDD, the first light emission control unit 108, the second light emission control unit 109, the light-emitting unit 107, and the second power supply PVEE. The light-emitting unit 107 emits light and displays the to-be-displayed brightness.

Figure 3:
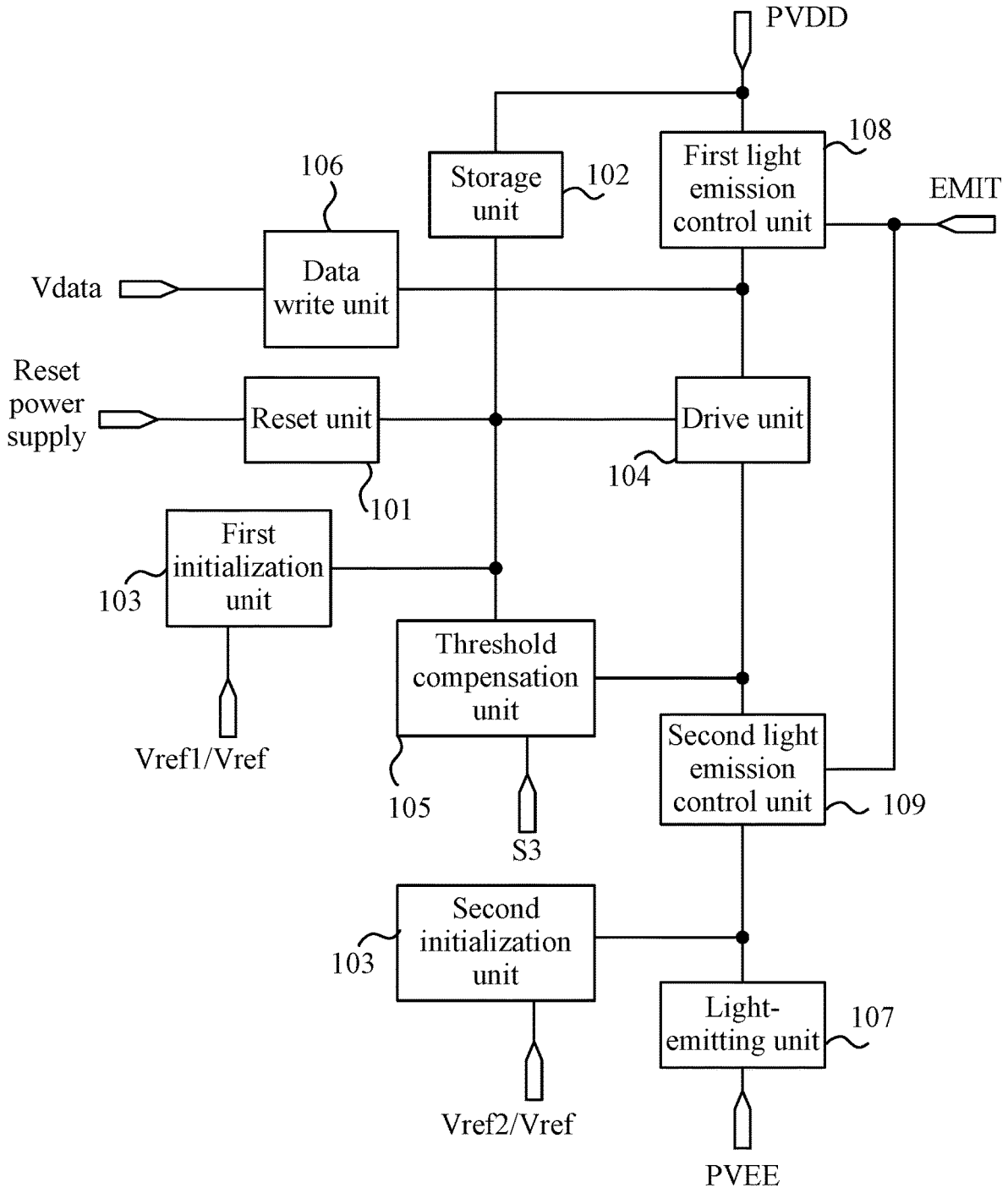
FIG. 3 is a diagram illustrating the structure of another pixel driving circuit according to an embodiment of the present disclosure.

Optionally, FIG. 3 is a diagram illustrating the structure of another pixel driving circuit according to an embodiment of the present disclosure. As shown in FIG. 3, the initialization unit 103 includes a first initialization unit 1031 and a second initialization unit 1032. The first initialization unit 1031 is connected between a first reference voltage output terminal VREF1 and the control terminal of the drive unit 104 and configured to provide a first initialization voltage Vref1 for the drive unit 104. The second initialization unit 1032 is connected between a second reference voltage output terminal VREF2 and the first terminal of the light-emitting unit 107 and configured to provide a second initialization voltage Vref2 for the light-emitting unit 107.

The pixel driving circuit also includes a first initialization unit 1031 and a second initialization unit 1032. The first initialization unit 1031 is connected between the first reference voltage output terminal VREF1 and the control terminal of the drive unit 104. In the initialization stage, the first initialization unit 1031 provides the first initialization voltage Vref1 for the drive unit 104 to clear the residual charge of the image of the previous frame in the control terminal of the drive unit 104, so that the writing of a data signal Vdata in the data write stage is facilitated. The second initialization unit 1032 is connected between a second reference voltage output terminal VREF2 and the first terminal of the light-emitting unit 107 and provides the second initialization voltage Vref2 for the light-emitting unit 107, so that the residual charge of the image of the previous frame in the light-emitting unit 107 may be cleared. In this manner, the light-emitting unit 107 can more accurately display the to-be-display brightness, thereby improving the image quality of the display panel. The control terminal of the second initialization unit 1032 may access a first scan signal line or a second scan signal line, so that the second initialization unit 1032 may initialize the light-emitting unit 107 in the initialization stage or the data write stage. When the first initialization unit 1031 and the second initialization unit 1032 are turned on in the initialization stage, the first initialization voltage Vref1 and the second initialization voltage Vref2 may be each the initialization voltage Vref output by the same initialization output terminal. When the first initialization unit 1031 is turned on in the initialization stage, the first initialization unit 1031 receives the first initialization voltage Vref1. When the second initialization unit 1032 is turned on in the data write stage, the second initialization unit 1032 receives the second initialization voltage Vref2. Although the on time of the first initialization unit 1031 and the second initialization unit 1032 is different, the first initialization voltage Vref1 and the second initialization voltage Vref2 may be the same signal, for example, −3.5V. Of course, the two may also be different signals. For example, the first initialization voltage Vref1 is −3.5V, and the second initialization voltage Vref2 is −3V. In the following embodiments, description is given by using an example in which the first initialization unit 1031 and the second initialization unit 1032 are turned on in the initialization stage, that is, the same initialization voltage Vref is received at the same time. In this manner, the number of signal lines can be reduced, the manufacturing cost can be reduced, and the complexity of the pixel driving circuit can be simplified.

Figure 4:
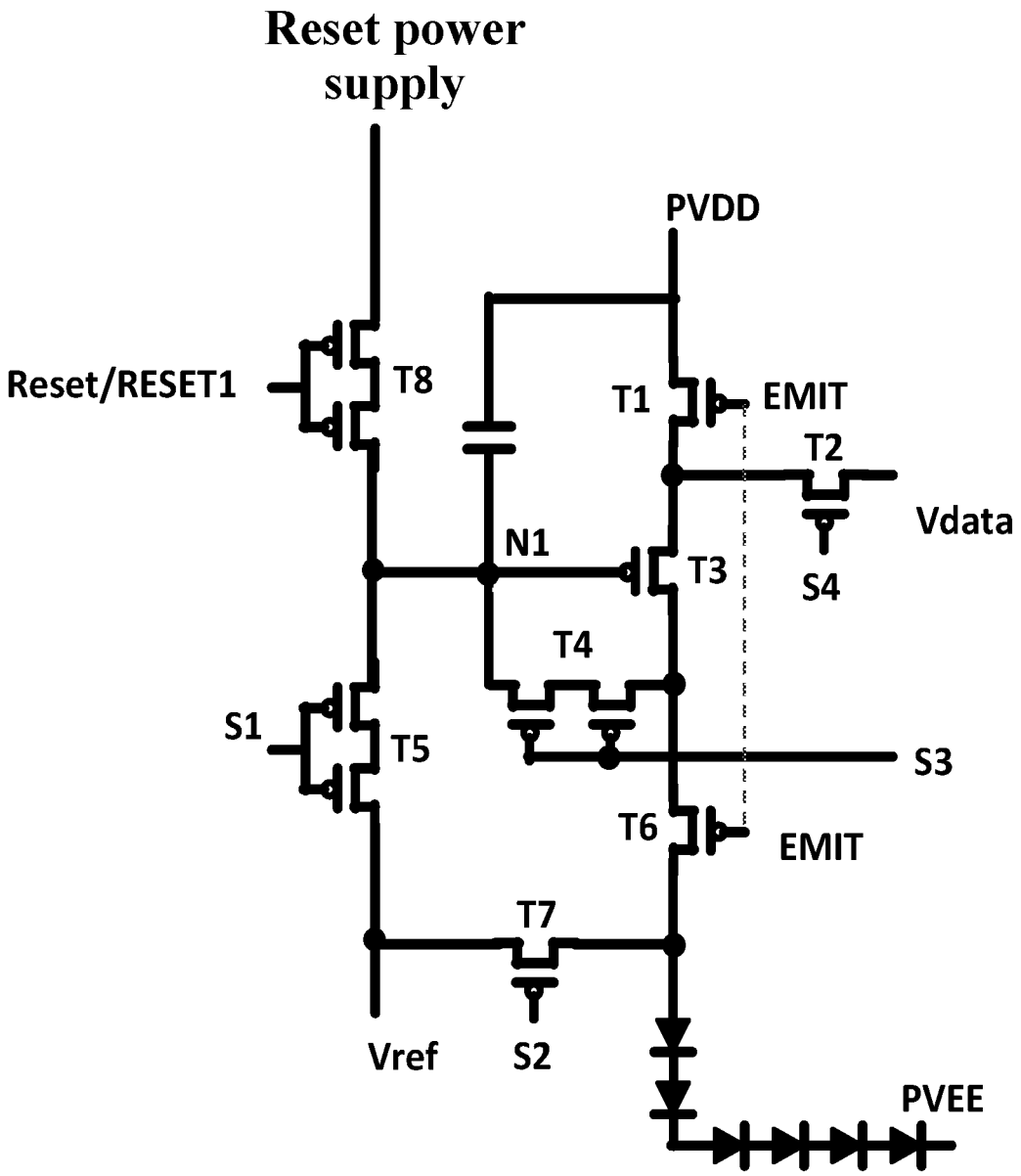
FIG. 4 is a diagram illustrating the structure of another pixel driving circuit according to an embodiment of the present disclosure.
Figure 5:
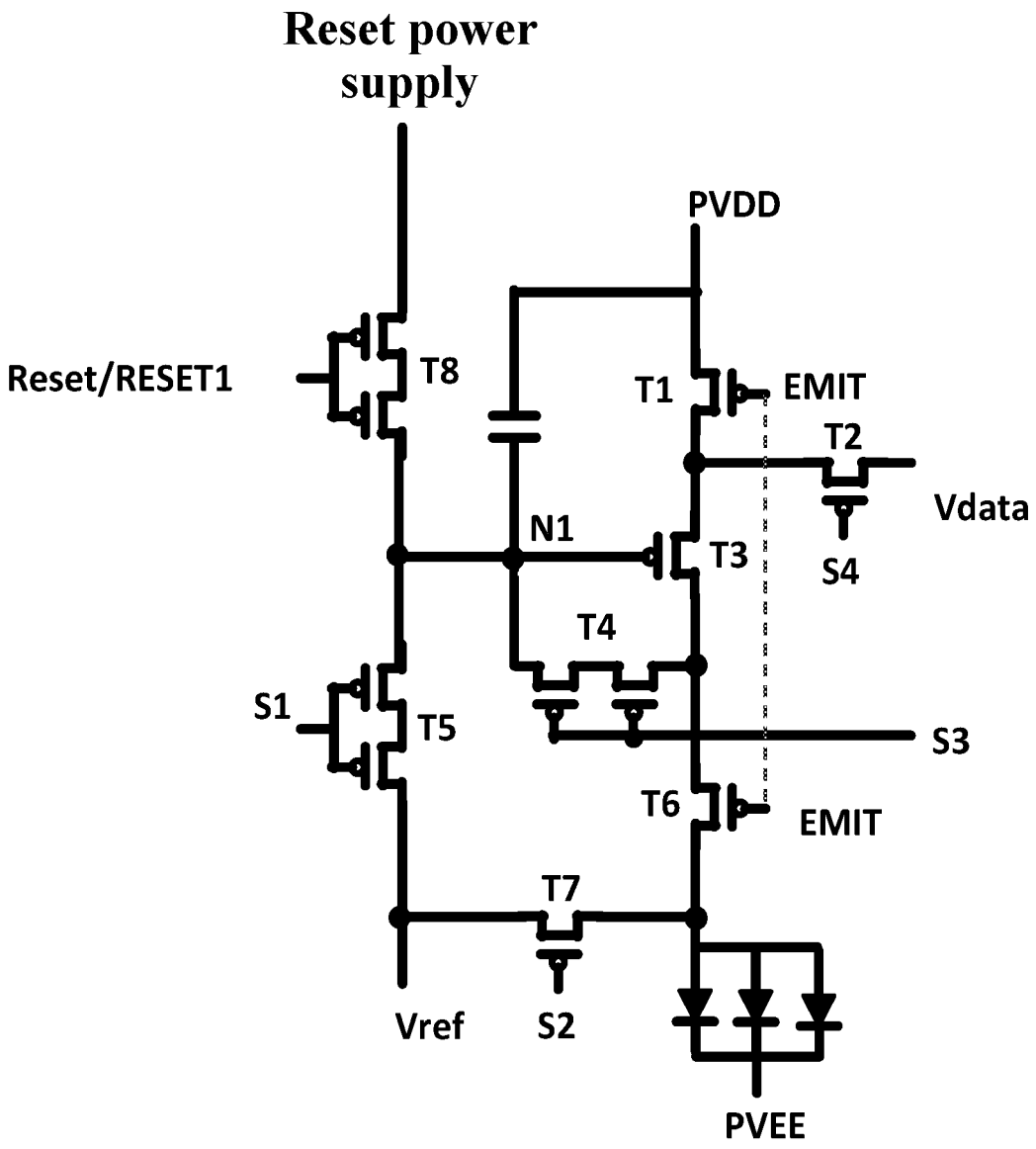
FIG. 5 is a diagram illustrating the structure of another pixel driving circuit according to an embodiment of the present disclosure.
Figure 6:
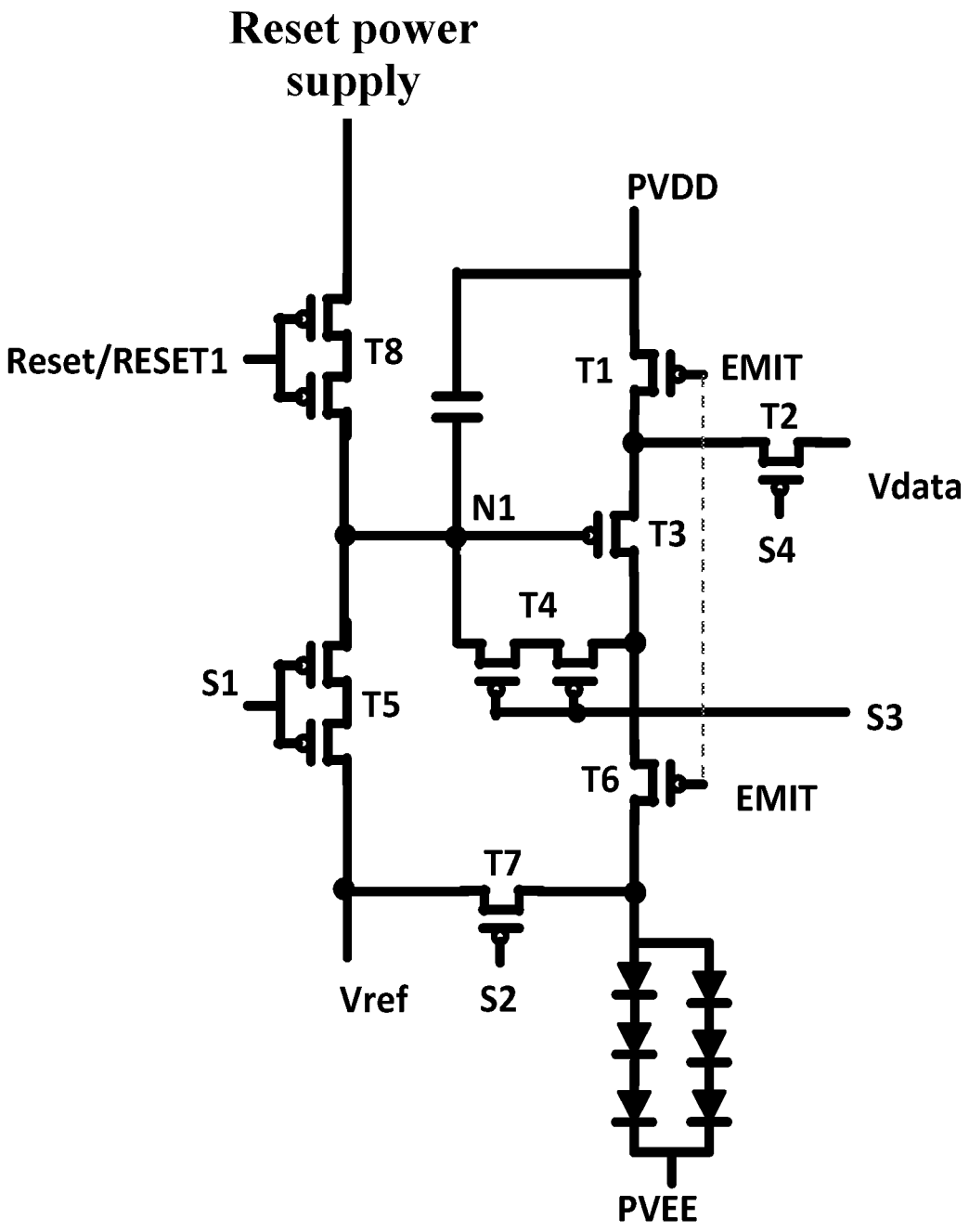
FIG. 6 is a diagram illustrating the structure of another pixel driving circuit according to an embodiment of the present disclosure.

Optionally, FIG. 4 is a diagram illustrating the structure of another pixel driving circuit according to an embodiment of the present disclosure. FIG. 5 is a diagram illustrating the structure of another pixel driving circuit according to an embodiment of the present disclosure. FIG. 6 is a diagram illustrating the structure of another pixel driving circuit according to an embodiment of the present disclosure. As shown in FIGS. 4, 5, and 6, the light-emitting unit 107 may include multiple micro LEDs connected in parallel and/or connected in series.

The light-emitting unit 107 may include multiple micro LEDs connected in series. As shown in FIG. 4, the light-emitting unit 107 may include six micro LEDs connected in series. Alternatively, the light-emitting unit 107 may include multiple micro LEDs connected in parallel. As shown in FIG. 5, the light-emitting unit 107 may include three micro LEDs connected in parallel. Alternatively, the light-emitting unit 107 may include multiple micro LEDs connected in series and in parallel. As shown in FIG. 6, the light-emitting unit 107 includes two micro LED strings, where each micro LED string includes three micro LEDs connected in series, and the two micro LED strings are connected in parallel. The preceding design, in combination with the preceding driving circuit, can avoid abnormal lighting of the light-emitting unit 107, thereby ensuring the display effect of the display panel. In particular, in the case where the light-emitting unit 107 in the pixel driving circuit includes multiple micro LEDs, the voltage requirement between the first power supply PVDD and the second power supply PVEE is increased. A small leakage current in the pixel driving circuit can also make the drive unit 104 turned on. As a result, the light-emitting unit 107 is lighted, and the screen flicker phenomenon of the display panel is caused. In the case where the light-emitting unit 107 includes multiple light-emitting elements, it is more necessary to adopt the reset unit 101 to control the drive unit 104 to be always in the off state during the power-on period. Thus, the occurrence of the screen flicker phenomenon of the display panel is effectively avoided, and the normal display effect of the display panel is ensured.

Figure 7:
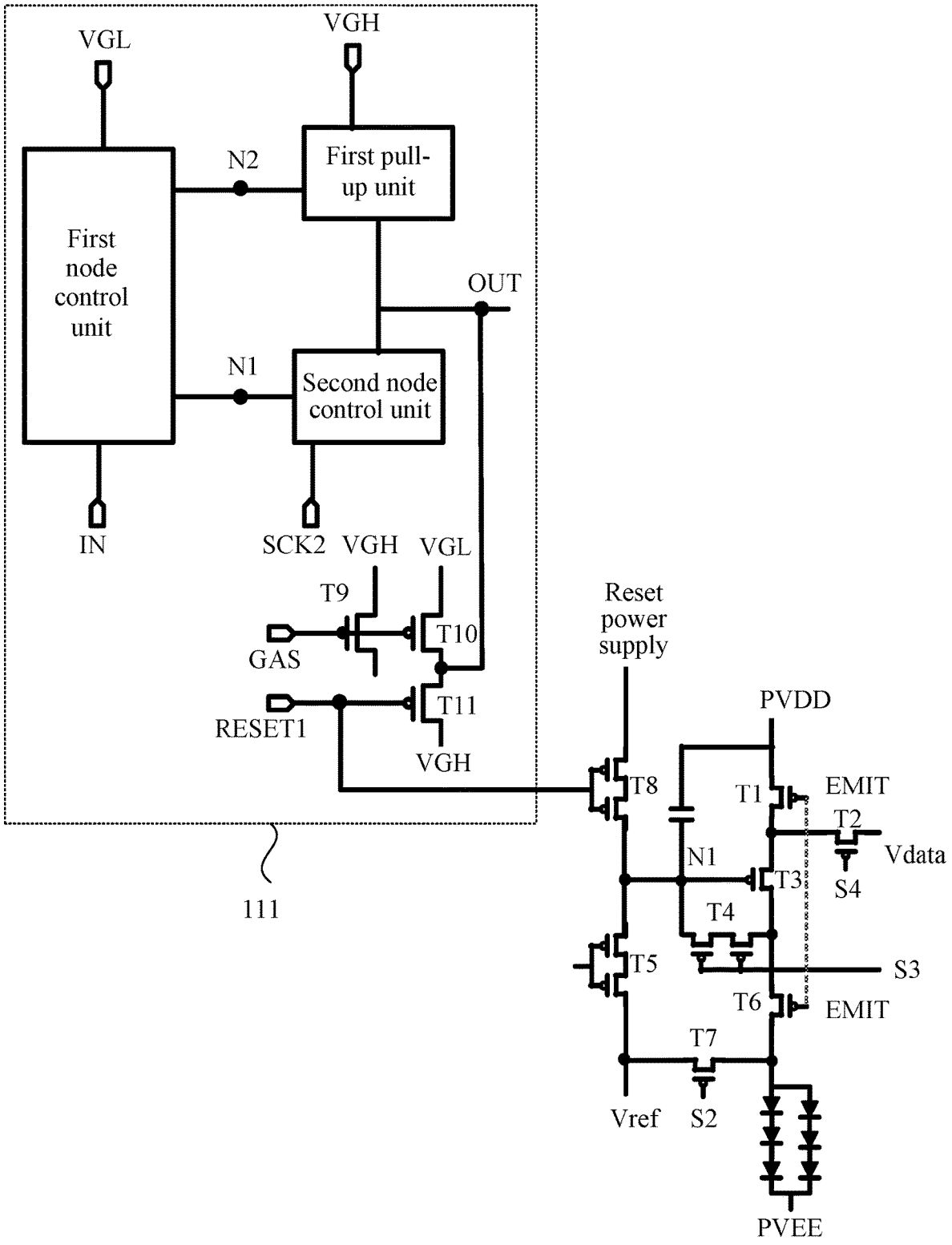
FIG. 7 is a diagram illustrating the structure of another pixel driving circuit according to an embodiment of the present disclosure.

Optionally, FIG. 7 is a diagram illustrating the structure of another pixel driving circuit according to an embodiment of the present disclosure. As shown in FIG. 7, the control terminal of the reset unit 101 is connected to a reset scan signal output terminal RESET. The reset scan signal output terminal RESET also serves as a reset signal output terminal RESET1 of a gate driving circuit 111.

The control terminal of the reset unit 101 is connected to the reset scan signal output terminal RESET. The reset scan signal output terminal RESET also serves as the reset signal output terminal RESET1 of the gate driving circuit 111. The output terminal OUT of a shift register may output a low-level signal VGL or a high-level signal VGH. When the first node N1 is at a turn-on level, and a second node N2 is at a turn-off level, the output terminal OUT of the shift register outputs the low-level signal VGL. When the first node N1 is at a turn-off level, and the second node N2 is at a turn-on level, the output terminal OUT of the shift register outputs the high-level signal VGH. Additionally, the reset signal output terminal RESET1 of the gate driving circuit 111 controls an eleventh transistor T11 to turn on during the power-on period. In this manner, the high-level signal VGH can be transmitted to a scan signal output terminal OUT, and the scan signal output terminal OUT of the gate driving circuit 111 is reset. Moreover, the problem of the power-on screen flicker of the display panel is avoided. When the display panel is in a normal scan time period, the reset signal output terminal RESET1 turns off the eleventh transistor T11, and the output terminal OUT of the shift register normally outputs a signal. The gate driving circuit 111 includes various reset signal output terminals RESET1. When a transistor in the reset unit 101 is a p-type transistor, a low-level reset signal in the gate driving circuit 111 may be selected to make the reset unit 101 turned on. When a transistor in the reset unit 101 is an n-type transistor, a high-level reset signal in the gate driving circuit 111 may be selected to make the reset unit 101 turned on. At the same time, the multiplexing of the reset signal output terminal RESET1 of the gate driving circuit 111 may avoid additional disposition of a signal line. In this manner, the number of signal lines can be reduced, the manufacturing cost can be reduced, and the complexity of the pixel driving circuit can be simplified.

Figure 8:
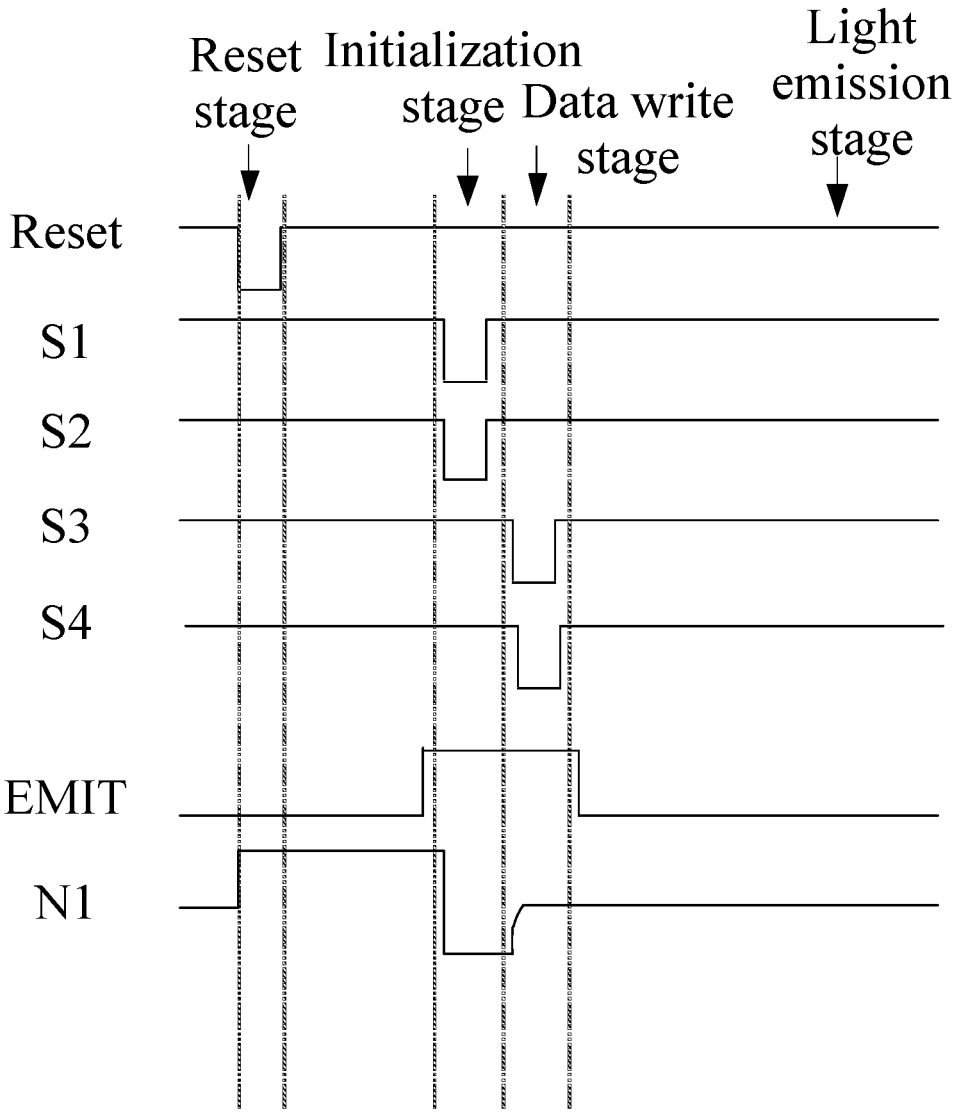
FIG. 8 is a timing diagram of a pixel driving circuit according to an embodiment of the present disclosure.

Optionally, FIG. 8 is a timing diagram of a pixel driving circuit according to an embodiment of the present disclosure. As shown in FIGS. 4, 5, 6, 7, and 8, the storage unit 102 includes a first capacitor Cst. The first light emission control unit includes a first transistor T1. The data write unit 103 includes a second transistor T2. The drive unit 104 includes a third transistor T3. The threshold compensation unit 105 includes a fourth transistor T4. The first initialization unit 1031 includes a fifth transistor T5. The second light emission control unit 1032 includes a sixth transistor T6. The second initialization unit 1032 includes a seventh transistor T7. The reset unit 101 includes an eighth transistor T8. The control terminal of the third transistor T3 is connected to a second terminal of the eighth transistor T8, a second terminal of the fifth transistor T5, and a first terminal of the fourth transistor T4 respectively. A first terminal of the third transistor T3 is connected to a second terminal of the first transistor T1. A first terminal of the first transistor is connected to the first power supply PVDD. A second terminal of the third transistor T3 is connected to a second terminal of the fourth transistor T4, and a first terminal of the sixth transistor T6 respectively. A second terminal of the sixth transistor T6 is connected to the first terminal of the light-emitting unit 107. A first terminal of the eighth transistor T8 is connected to the reset power supply. A first terminal of the fifth transistor T5 is connected to the first reference voltage output terminal VREF1. A first terminal of the second transistor T2 is connected to a data signal line DATA. A second terminal of the second transistor T2 is connected to the first terminal of the third transistor T3. A first terminal of the seventh transistor T7 is connected to the second reference voltage output terminal VREF2. A second terminal of the seventh transistor T7 is connected to the first terminal of the light-emitting unit 107. The control terminal of the first transistor T1 and the control terminal of the sixth transistor T6 are connected to a light emission control signal line EM. The control terminal of the fifth transistor T5 is connected to the first scan signal line S1. The control terminal of the seventh transistor T7 is connected to the second scan signal line S2. The control terminal of the fourth transistor T4 is connected to a third scan signal line S3. The control terminal of the second transistor T2 is connected to a fourth scan signal line S4.

The first transistor T1, the second transistor T2, the third transistor T3, the fourth transistor T4, the fifth transistor T5, the sixth transistor T6, the seventh transistor T7, and the eighth transistor T8 are each a p-type transistor. A p-type transistor is turned on at a low level and is turned off at a high level. For example, the working principle of the pixel driving circuit is described with reference to FIGS. 4, 5, and 6 by using an example in which the control terminal of the eighth transistor T8 is connected to the reset signal output terminal RESET1 of the gate driving circuit, and the first reference voltage output terminal VREF1 and the second reference voltage output terminal VREF2 are the same reference voltage output terminal VREF. In the power-on reset stage, the signal Reset output by the reset signal output terminal RESET1 and the signal EMIT on the light emission control signal line EM are low levels, and the signal S1 on the first scan signal line, the signal S2 on the second scan signal line, the signal S3 on the third scan signal line, and the signal S4 on the fourth scan signal line are each a high level. At this time, the eighth transistor T8, the first transistor T1, and the sixth transistor T6 are turned on, and the second transistor T2, the third transistor T3, the fourth transistor T4, the fifth transistor T5, and the seventh transistor T7 are turned off. The signal output by the reset power supply is transmitted to the control terminal of the third transistor T3 through the eighth transistor T8. At this time, the signal output by the reset power supply is a high level. The signal output by the reset power supply resets the control terminal of the third transistor T3. In this manner, in the power-on reset stage, the third transistor T3 is always in an off state, so that the third transistor T3 is prevented from being affected by the leakage current of the fifth transistor T5, thereby preventing the third transistor T3 from being abnormally turned on. Thus, the display effect of the display panel is ensured.

In the initialization stage, the signal S1 on the first scan signal line and the signal S2 on the second scan signal line are each a low level. The signal EMIT on the light emission control signal line EM, the signal S3 on the third scan signal line, the signal S4 on the fourth scan signal line, and the signal Reset output by the reset signal output terminal RESET1 are each a high level. At this time, the fifth transistor T5, and the seventh transistor T7 are turned on, and the first transistor T1, the second transistor T2, the third transistor T3, the fourth transistor T4, the sixth transistor T6, and the eighth transistor T8 are turned off. The potential on the first reference voltage output terminal VREF1 is applied to the first capacitor Cst through the fifth transistor T5, that is, the potential of the first node N1 is the initialization voltage Vref. At this time, the potential of the control terminal of a drive transistor T3 is also the initialization voltage Vref, and the residual charge of the previous frame in the control terminal of the drive transistor T3 is cleared. At the same time, the fifth transistor T5 is a double-gate transistor. Thus, the current leakage phenomenon in the pixel driving circuit is further reduced, and the stability of the potential of the first node N1 is ensured. In the initialization stage, the seventh transistor T7 is also turned on. The seventh transistor T7 writes the potential on the second reference voltage output terminal VREF2 to the first terminal of the light-emitting unit 107, and then the potential on the first terminal of the light-emitting unit 107 is initialized. In this manner, the influence of the voltage of the first terminal of the light-emitting unit 107 of a preceding frame on the voltage of the first terminal of the light-emitting unit 107 of a succeeding frame is reduced, and display uniformity is further improved.

In the data write stage, the signal S3 on the third scan signal line and the signal S4 on the fourth scan signal line are each a low level. The signal S1 on the first scan signal line, the signal S2 on the second scan signal line, the signal EMIT on the light emission control signal line EM and the signal Reset output by the reset signal output terminal RESET1 are each a high level. The second transistor T2 and the fourth transistor T4 are turned on. The first transistor T1, the fifth transistor T5, the sixth transistor T6, the seventh transistor T7, and the eighth transistor T8 are turned off. At this time, the data signal Vdata is written into the second transistor T2 and the fourth transistor T4. The potential of the control terminal of the drive transistor T3 is the initialization voltage Vref and also a low potential. The third transistor T3 is also turned on. The data signal Vdata on the data signal line DATA is written into the second transistor T2, the third transistor T3, and the fourth transistor T4 and is applied to the first node N1. The potential of the first node N1 is gradually pulled up by the potential on the data signal line DATA. When the gate voltage of the third transistor T3 is pulled up to a voltage, where the voltage difference between this voltage and the voltage of the source of the third transistor is equal to the threshold voltage of the third transistor T3, the third transistor T3 is in an off state, and the data write stage ends. At the same time, the fourth transistor T4 is a double-gate transistor. Thus, the current leakage phenomenon in the pixel driving circuit is reduced, and the stability of the potential of the first node N1 is ensured.

In the light emission stage, the signal EMIT on the light emission control signal line EM is a low level. The signal S1 on the first scan signal line, the signal S2 on the second scan signal line, the signal S3 on the third scan signal line, the signal S4 on the fourth scan signal line, and the signal Reset output by the reset signal output terminal RESET1 are each a high level. At this time, the first transistor T1 and the sixth transistor T6 are turned on, and the second transistor T2, the third transistor T3, the fourth transistor T4, the fifth transistor T5, the seventh transistor T7, and the eighth transistor T8 are turned off. A path is formed between the first power supply PVDD and the second power supply PVEE. The third transistor T3 outputs the light-emitting drive signal to the light-emitting unit 107. The light-emitting unit 107 emits light.

In the pixel driving circuit, the first transistor T1, the second transistor T2, the third transistor T3, the fourth transistor T4, the fifth transistor T5, the sixth transistor T6, the seventh transistor T7, and the eighth transistor T8 are each an n-type transistor. An n-type transistor is turned on at a high level and is turned off at a low level. The principle of the specific working process of the pixel driving circuit is the same as that of the pixel driving circuit in which the first transistor T1, the second transistor T2, the third transistor T3, the fourth transistor T4, the fifth transistor T5, the sixth transistor T6, the seventh transistor T7, and the eighth transistor T8 are each a p-type transistor. Repetition is not made herein.

Optionally, with continued reference to FIGS. 4, 5, 6, 7, and 8, the first scan signal line, the second scan signal line, the third scan signal line, and the fourth scan signal line are configured to implement the operations below.

In the power-on reset stage, the first transistor T1, the sixth transistor T6, and the eighth transistor T8 are driven to turn on, and the second transistor T2, the third transistor T3, the fourth transistor T4, the fifth transistor T5, and the seventh T7 are driven to turn off. In an initialization sub-stage in a scan time period, the fifth transistor T5, and the seventh transistor T7 are driven to turn on, and the first transistor T1, the second transistor T2, the fourth transistor T4, the third transistor T3, the sixth transistor T6, and the eighth transistor T8 are driven to turn off. In the data write stage in the scan time period, the second transistor T2, the third transistor T3, and the fourth transistor T4 are driven to turn on, and the first transistor T1, the fifth transistor T5, the sixth transistor T6, the seventh transistor T7, and the eighth transistor T8 are driven to turn off. In the light emission stage in the scan time period, the first transistor T1, the third transistor T3, and the sixth transistor T6 are driven to turn on, and the second transistor T2, the fourth transistor T4, the fifth transistor T5, the seventh transistor T7, and the eighth transistor T8 are driven to turn off.

In the power-on reset stage, the signal S1 on the first scan signal line, the signal S2 on the second scan signal line, the signal S3 on the third scan signal line, and the signal S4 on the fourth scan signal line are each a high level. The signal Reset output by the reset signal output terminal RESET1 and the signal EMIT on the light emission control signal line EM are each a low level. The first scan signal line, the second scan signal line, the third scan signal line, the fourth scan signal line, the first transistor T1, the sixth transistor T6, and the eighth transistor T8 are turned on. The second transistor T2, the third transistor T3, the fourth transistor T4, the fifth transistor T5, and the seventh T7 are turned off.

In the initialization sub-stage in the scan time period, the signal S1 on the first scan signal line and the signal S2 on the second scan signal line are each a low level. The signal EMIT on the light emission control signal line EM, the signal S3 on the third scan signal line, the signal S4 on the fourth scan signal line, and the signal Reset output by the reset signal output terminal RESET1 are each a high level. The fifth transistor T5 and the seventh transistor T7 are turned on. The first transistor T1, the second transistor T2, the fourth transistor T4, the third transistor T3, the sixth transistor T6, and the eighth transistor T8 are turned off.

In the data write stage in the scan time period, the signal S3 on the third scan signal line and the signal S4 on the fourth scan signal line are each a low level. The signal S1 on the first scan signal line, the signal S2 on the second scan signal line, the signal EMIT on the light emission control signal line EM, and the signal Reset output by the reset signal output terminal RESET1 are each a high level. The second transistor T2, the third transistor T3, and the fourth transistor T4 are turned on. The first transistor T1, the fifth transistor T5, the sixth transistor T6, the seventh transistor T7, and the eighth transistor T8 are turned off.

In the light emission stage in the scan time period, the signal EMIT on the light emission control signal line EM is a low level. The signal S1 on the first scan signal line, the signal S2 on the second scan signal line, the signal S3 on the third scan signal line, the signal S4 on the fourth scan signal line, and the signal Reset output by the reset signal output terminal RESET1 are each a high level. The first transistor T1, the third transistor T3, and the sixth transistor T6 are turned on. The second transistor T2, the fourth transistor T4, the fifth transistor T5, the seventh transistor T7, and the eighth transistor T8 are turned off.

Figure 9:
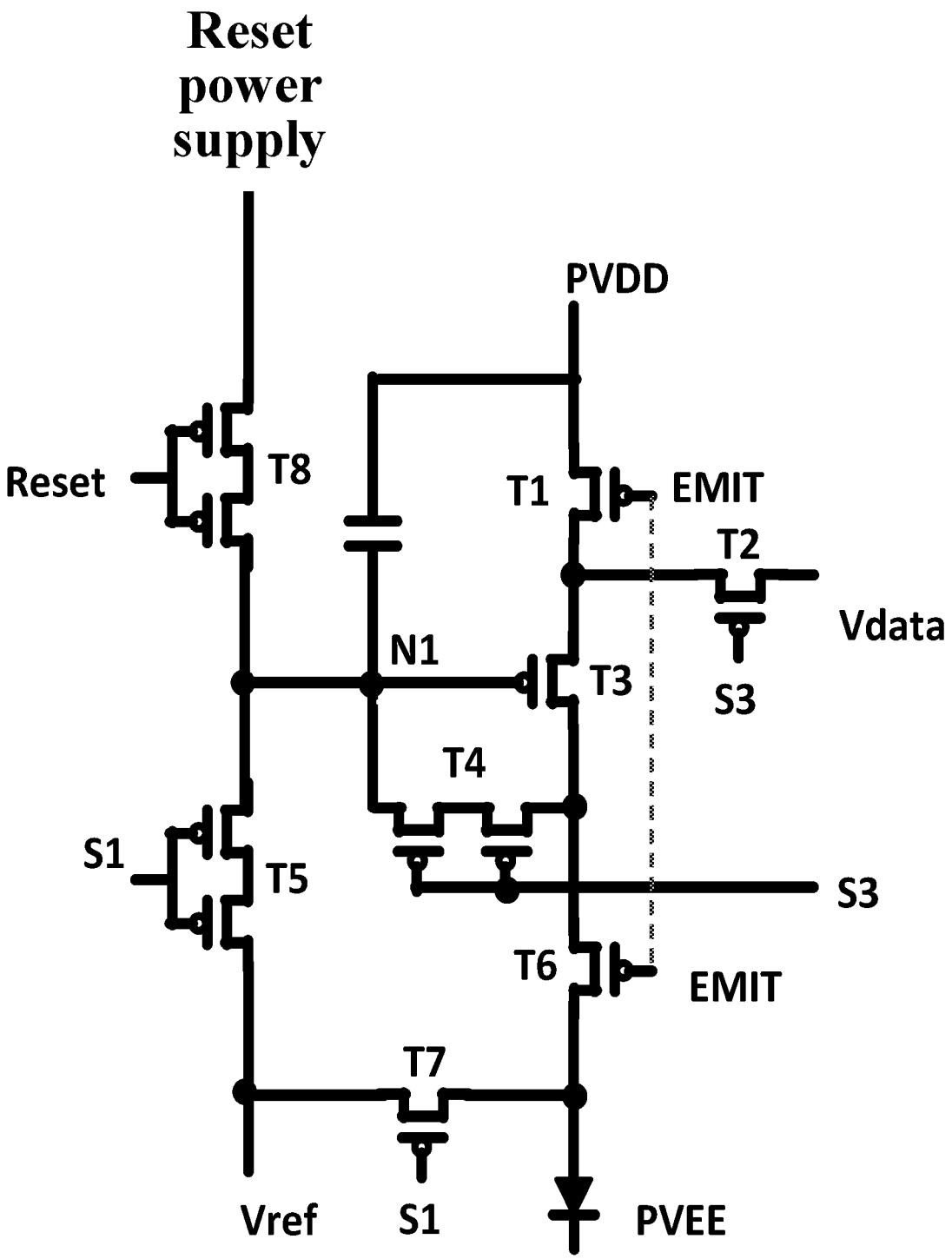
FIG. 9 is a diagram illustrating the structure of another pixel driving circuit according to an embodiment of the present disclosure.
Figure 10:
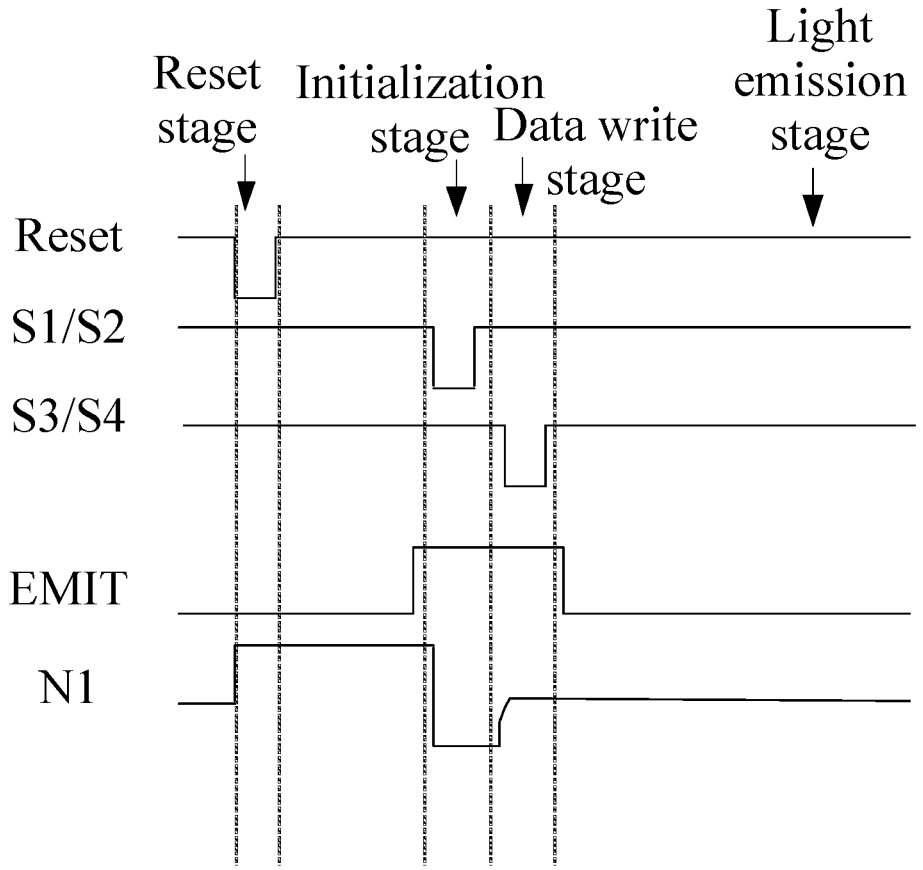
FIG. 10 is a timing diagram of another pixel driving circuit according to an embodiment of the present disclosure.

Optionally, FIG. 9 is a diagram illustrating the structure of another pixel driving circuit according to an embodiment of the present disclosure. FIG. 10 is a timing diagram of another pixel driving circuit according to an embodiment of the present disclosure. As shown in FIGS. 9 and 10, the first transistor T1, the second transistor T2, the third transistor T3, the fourth transistor T4, the fifth transistor T5, the sixth transistor T6, the seventh transistor T7, and the eighth transistor T8 are each a p-type transistor. The first scan signal line also serves as the second scan signal line. The third scan signal line also serves as the fourth scan signal line.

Since the fifth transistor T5 and the seventh transistor T7 are each a p-type transistor, in the initialization stage, the fifth transistor T5 and the seventh transistor T7 may be turned on at the same time. At this time, the control terminal of the fifth transistor T5 and the control terminal of the seventh transistor T7 may access the same low-level scan signal. In this manner, the first scan signal line may also serve as the second scan signal line to ensure that in the initialization stage, the fifth transistor T5 and the seventh transistor T7 are turned on at the same time; and in a non-initialization stage, the fifth transistor T5 and the seventh transistor T7 are turned off at the same time. Similarly, since the second transistor T2 and the fourth transistor T4 are each a p-type transistor, in the initialization stage, the second transistor T2 and the fourth transistor T4 may be turned on at the same time. At this time, the control terminal of the second transistor T2 and the control terminal of the fourth transistor T4 may access the same low-level scan signal. In this manner, the third scan signal line may also serve as the fourth scan signal line to ensure that in the data write stage, the second transistor T2 and the fourth transistor T4 are turned on at the same time; and in a non-data write stage, the second transistor T2 and the fourth transistor T4 are turned off at the same time. The multiplexing of scan lines can effectively reduce the number of scan lines, reduce the manufacturing cost, and simplify the complexity of the pixel driving circuit.

Figure 11:
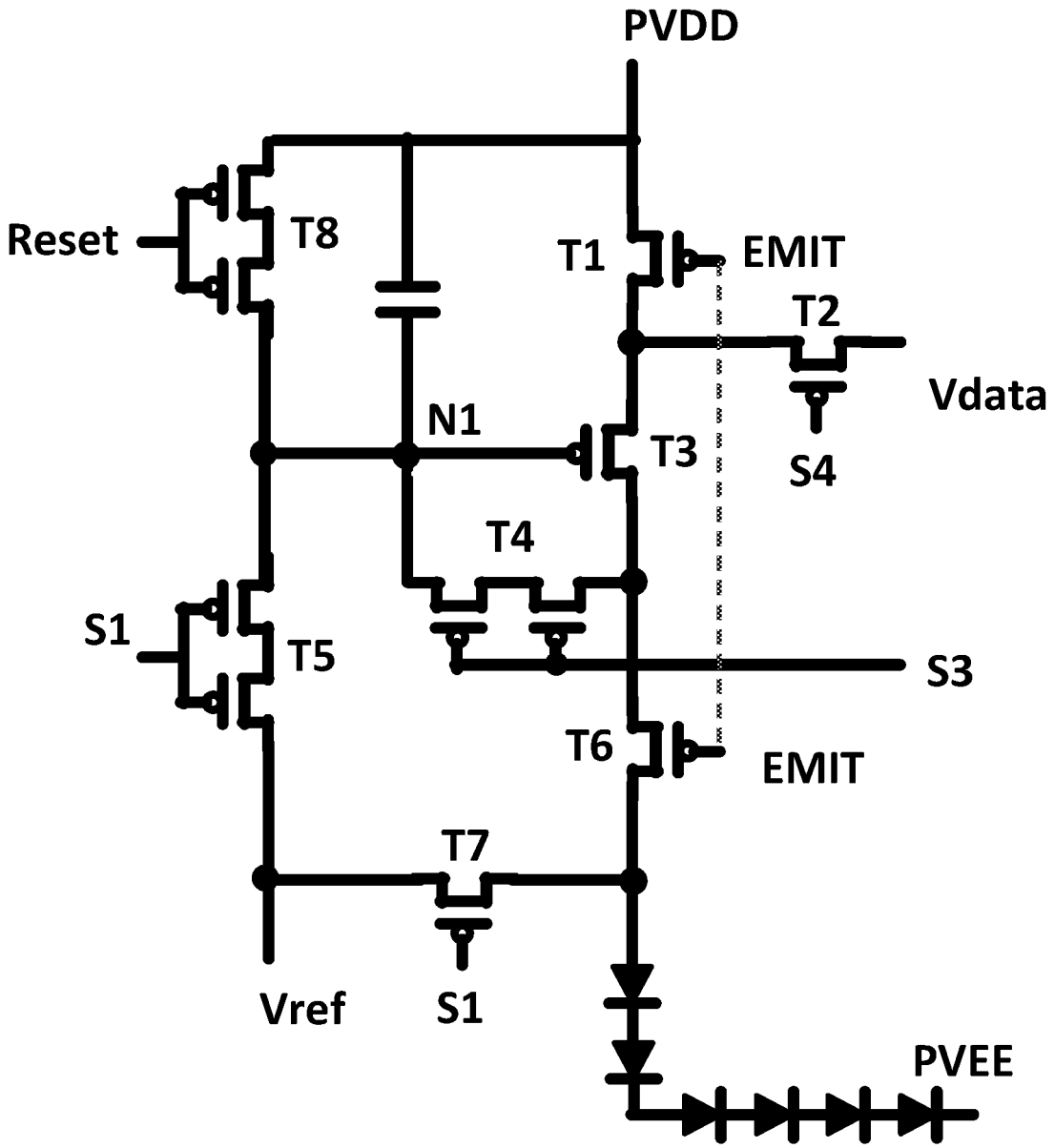
FIG. 11 is a diagram illustrating the structure of another pixel driving circuit according to an embodiment of the present disclosure.
Figure 12:
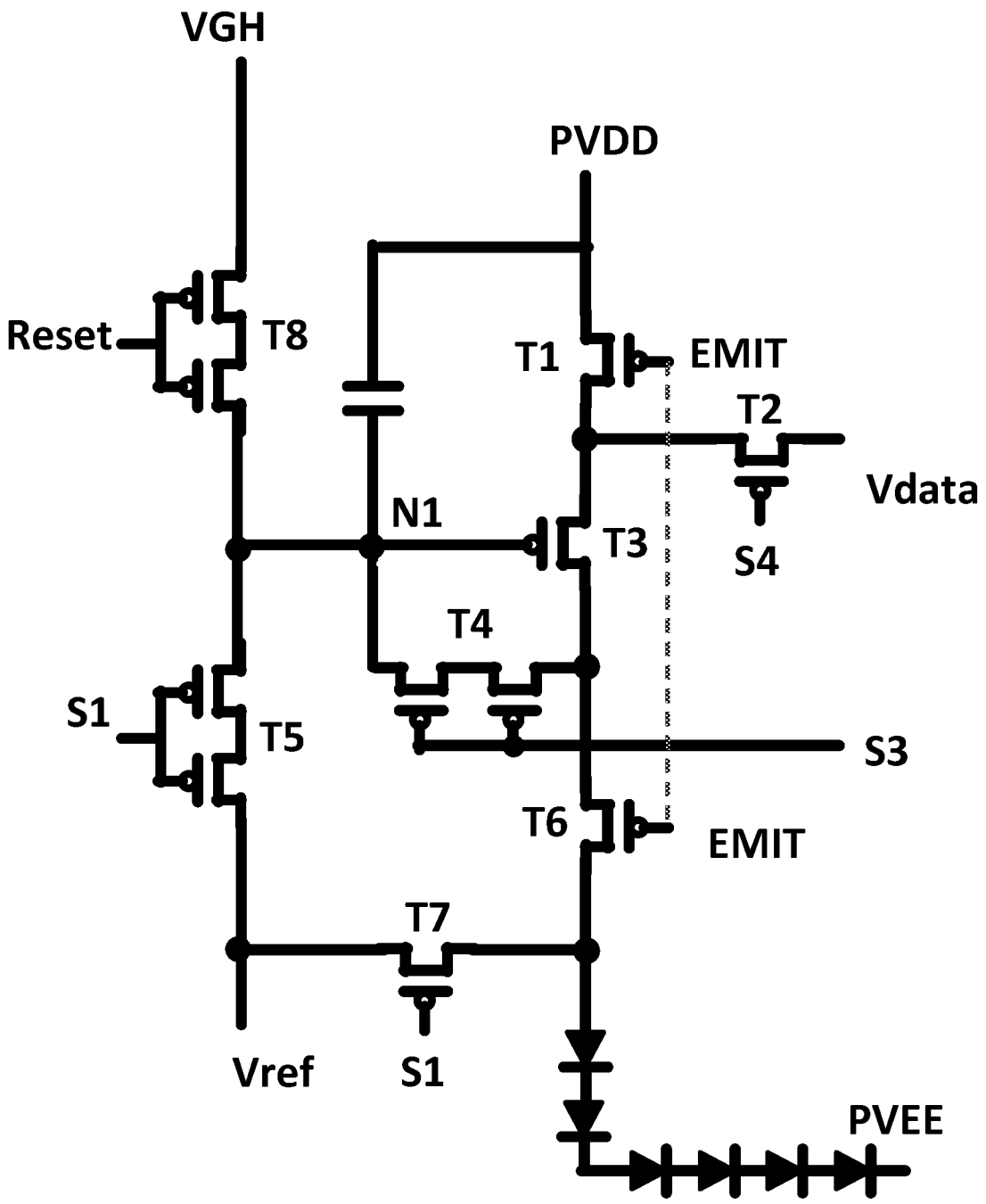
FIG. 12 is a diagram illustrating the structure of another pixel driving circuit according to an embodiment of the present disclosure.

Optionally, FIG. 11 is a diagram illustrating the structure of another pixel driving circuit according to an embodiment of the present disclosure. FIG. 12 is a diagram illustrating the structure of another pixel driving circuit according to an embodiment of the present disclosure. As shown in FIGS. 11 and 12, the first power supply PVDD also serves as the reset power supply, or a high-voltage signal terminal VGH of the gate driving circuit also serves as the reset power supply.

The third transistor T3 is a p-type transistor. The third transistor T3 is turned on at a low level and is turned off at a high level. Since in the power-on reset stage, to prevent the third transistor T3 from being abnormally turned on, at this time, it is necessary to write a high level to the control terminal of the third transistor T3. As shown in FIG. 11, the first power supply PVDD is generally a high-level signal. Thus, the first power supply PVDD may also serve as the reset power supply. Alternatively, as shown in FIG. 12, the high-voltage signal terminal VGH of the gate driving circuit outputs a high-level signal. The high-voltage signal terminal VGH of the gate driving circuit also serves as the reset power supply. The multiplexing of the first power supply PVDD or the high-voltage signal terminal VGH of the gate driving circuit can avoid additional disposition of a reset power supply, reduce the manufacturing cost, and simplify the complexity of the pixel driving circuit.

Optionally, with continued reference to FIGS. 11 and 12, if multiple light-emitting elements 107 are provided, the high-voltage signal terminal VGH of the gate driving circuit also serves as the reset power supply. If one light-emitting element 107 is provided, the first power supply PVDD also serves as the reset power supply.

As shown in FIG. 11, when only one light-emitting element is disposed in the light-emitting unit 107, the first power supply PVDD also serves as the reset power supply and is configured to provide the reset power supply for the control terminal of the drive unit 104. At this time, no additional wiring is required to adopt the high-voltage signal terminal VGH in the gate driving circuit. Moreover, a small reset voltage enables the fifth transistor T5 to easily reset the first node N1 in the initialization stage. As shown in FIG. 12, when multiple light-emitting elements are disposed in the light-emitting unit 107, for example, six light-emitting elements are disposed in the light-emitting unit 107, the voltage between the first power supply PVDD and the second power supply PVEE is too high. If the drive unit 104 is slightly turned on, and a screen flicker problem occurs, the high-voltage signal terminal VGH of the gate driving circuit also serves as the reset power supply. The voltage output by the high-voltage signal terminal VGH is high, so that the possibility that the light-emitting element in the light-emitting unit 107 is turned on can further be reduced, thereby effectively avoiding the occurrence of the screen flicker phenomenon of the display panel.

Figure 13:
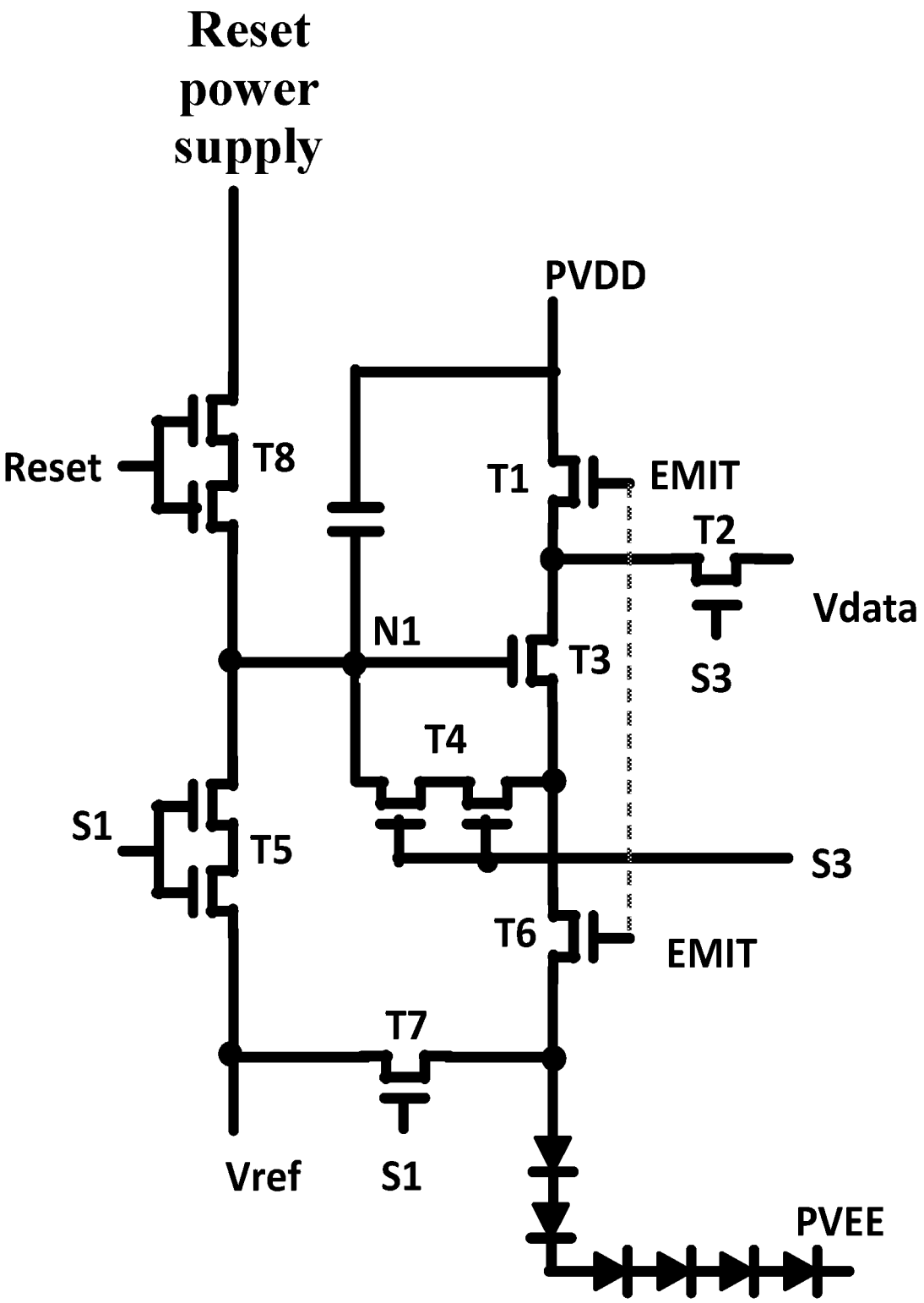
FIG. 13 is a diagram illustrating the structure of another pixel driving circuit according to an embodiment of the present disclosure.
Figure 14:
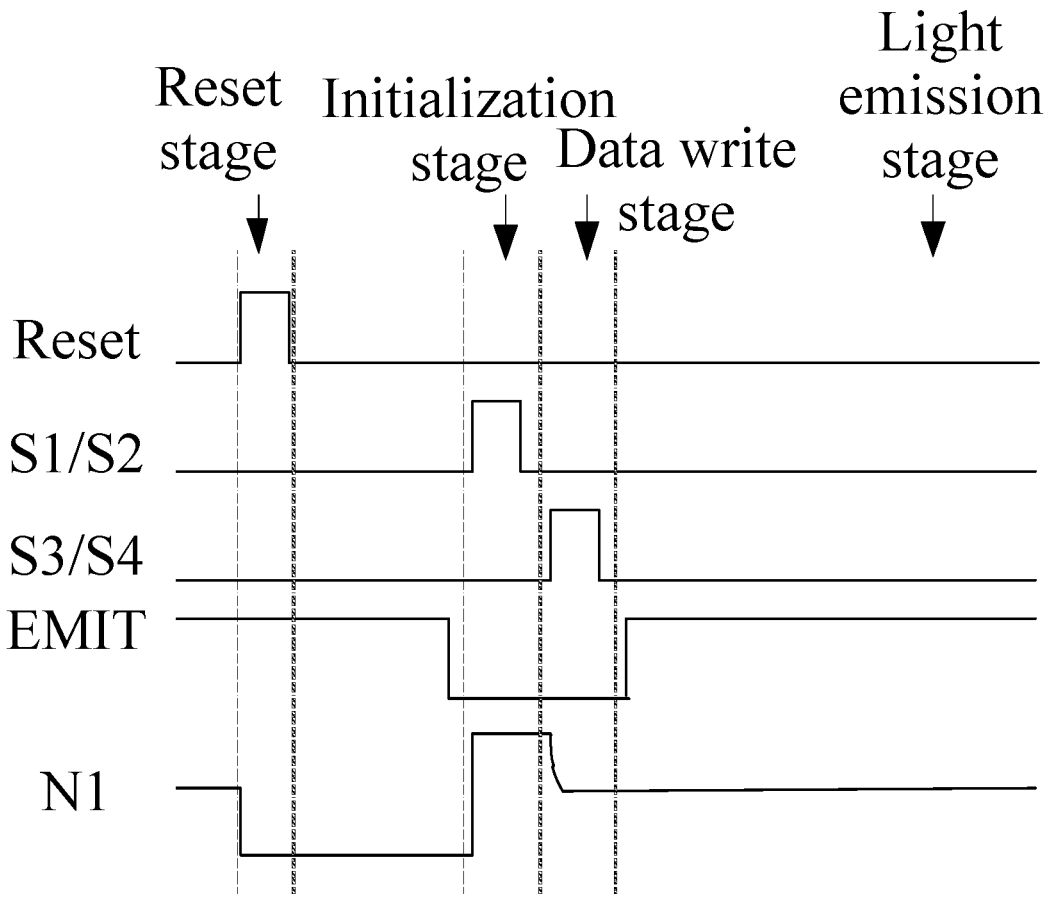
FIG. 14 is a timing diagram of another pixel driving circuit according to an embodiment of the present disclosure.

Optionally, FIG. 13 is a diagram illustrating the structure of another pixel driving circuit according to an embodiment of the present disclosure. FIG. 14 is a timing diagram of another pixel driving circuit according to an embodiment of the present disclosure. As shown in FIGS. 13 and 14, the first transistor T1, the second transistor T2, the third transistor T3, the fourth transistor T4, the fifth transistor T5, the sixth transistor T6, the seventh transistor T7, and the eighth transistor T8 are each an n-type transistor. The first scan signal line also serves as the second scan signal line. The third scan signal line also serves as the fourth scan signal line.

Since the fifth transistor T5 and the seventh transistor T7 are each an n-type transistor, in the initialization stage, the fifth transistor T5 and the seventh transistor T7 may be turned on at the same time. At this time, the control terminal of the fifth transistor T5 and the control terminal of the seventh transistor T7 may access the same high-level scan signal. In this manner, the first scan signal line may also serve as the second scan signal line to ensure that in the initialization stage, the fifth transistor T5 and the seventh transistor T7 are turned on at the same time; and in the non-initialization stage, the fifth transistor T5 and the seventh transistor T7 are turned off at the same time. Similarly, since the second transistor T2 and the fourth transistor T4 are each an n-type transistor, in the initialization stage, the second transistor T2 and the fourth transistor T4 may be turned on at the same time. At this time, the control terminal of the second transistor T2 and the control terminal of the fourth transistor T4 may access the same high-level scan signal. In this manner, the third scan signal line may also serve as the fourth scan signal line to ensure that in the data write stage, the second transistor T2 and the fourth transistor T4 are turned on at the same time; and in the non-data write stage, the second transistor T2 and the fourth transistor T4 are turned off at the same time. The multiplexing of the scan lines can effectively reduce the number of scan lines, reduce the manufacturing cost, and simplify the complexity of the pixel driving circuit.

Figure 15:
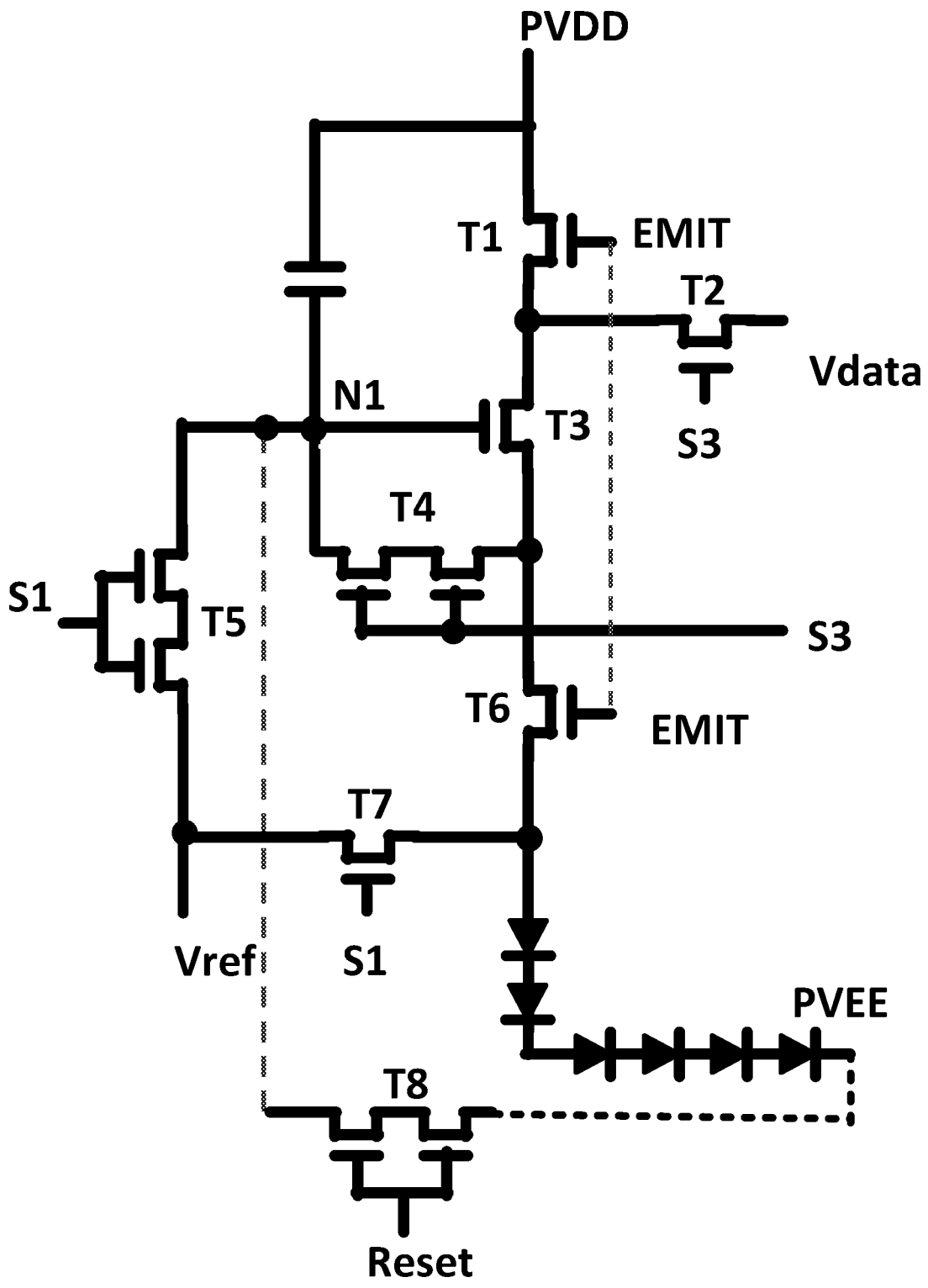
FIG. 15 is a diagram illustrating the structure of another pixel driving circuit according to an embodiment of the present disclosure.
Figure 16:
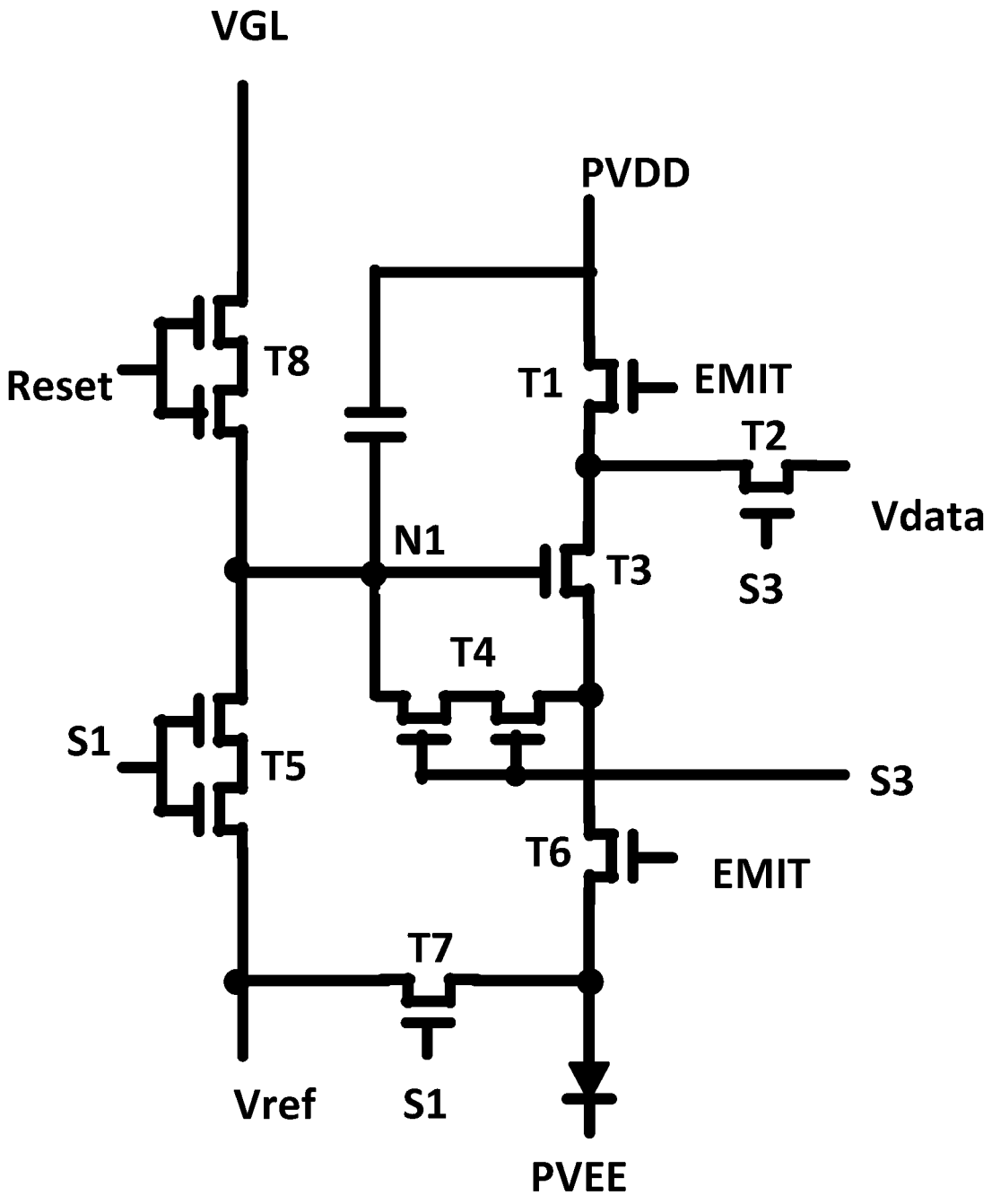
FIG. 16 is a diagram illustrating the structure of another pixel driving circuit according to an embodiment of the present disclosure.
Figure 17:
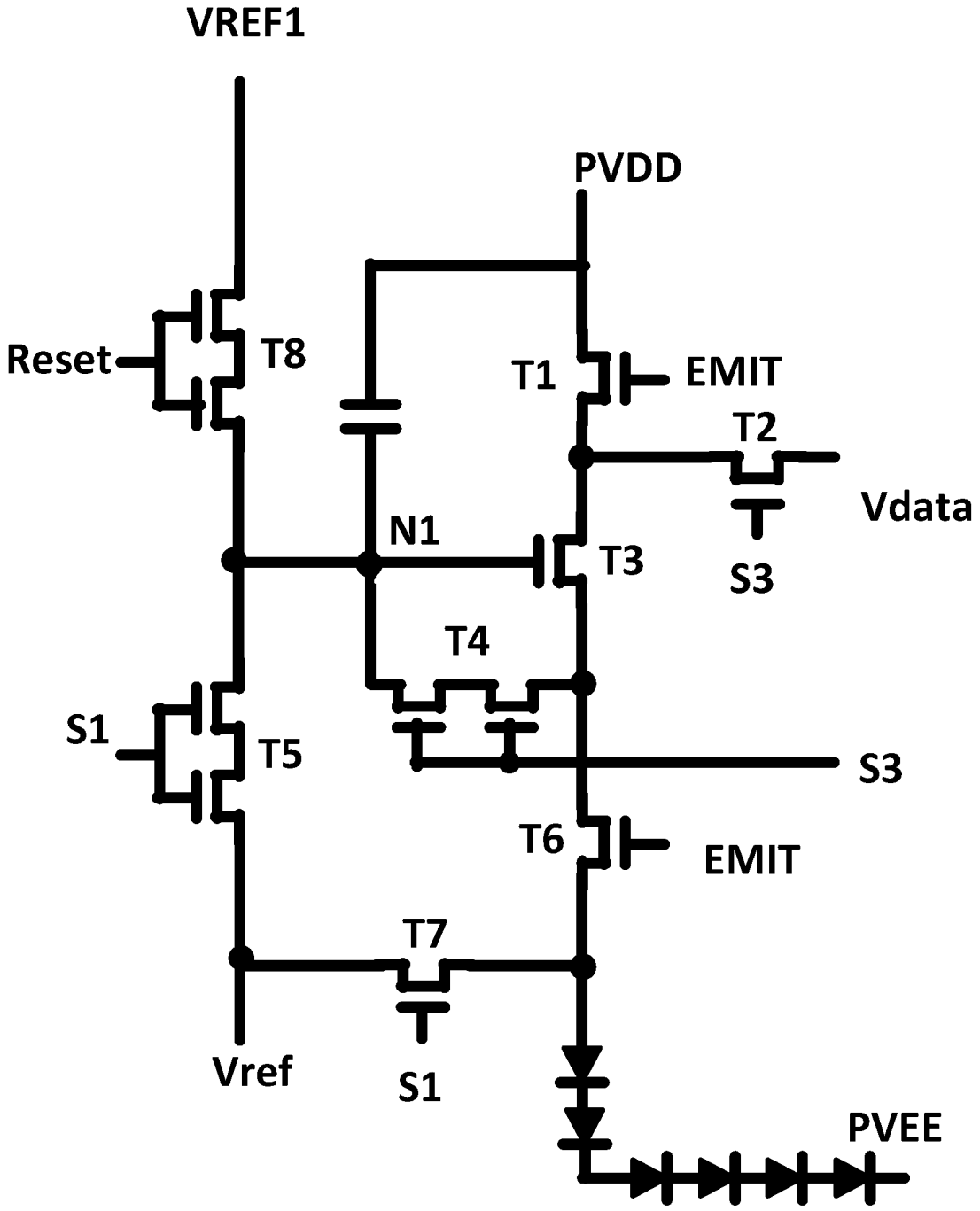
FIG. 17 is a diagram illustrating the structure of another pixel driving circuit according to an embodiment of the present disclosure.

Optionally, FIG. 15 is a diagram illustrating the structure of another pixel driving circuit according to an embodiment of the present disclosure. FIG. 16 is a diagram illustrating the structure of another pixel driving circuit according to an embodiment of the present disclosure. FIG. 17 is a diagram illustrating the structure of another pixel driving circuit according to an embodiment of the present disclosure. As shown in FIGS. 15, 16, and 17, the second power supply PVEE also serves as the reset power supply, or a low-voltage signal terminal VGL of the gate driving circuit also serves as the reset power supply. The first reference voltage output terminal VREF1 or the second reference voltage output terminal VREF2 also serves as the reset power supply.

The third transistor T3 is an n-type transistor. The third transistor T3 is turned on at a high level and is turned off at a low level. Since in the power-on reset stage, to prevent the third transistor T3 from being abnormally turned on, at this time, it is necessary to write a low level to the control terminal of the third transistor T3. As shown in FIG. 15, the second power supply PVEE is generally a low-level signal. Thus, the second power supply PVEE may also serve as the reset power supply. Alternatively, as shown in FIG. 16, the low-voltage signal terminal VGL of the gate driving circuit outputs a low-level signal. The low-voltage signal terminal VGL of the gate driving circuit also serves as the reset power supply. The second power supply PVEE or the low-voltage signal terminal VGL of the gate driving circuit is multiplexed. Alternatively, as shown in FIG. 17, the first reference voltage output terminal VREF1 outputs a low-level signal. The first reference voltage output terminal VREF1 also serves as the reset power supply. Similarly, the second reference voltage output terminal VREF2 also outputs a low-level signal. The second reference voltage output terminal VREF2 may also serve as the reset power supply. The multiplexing of the second power supply PVEE, the low-voltage signal terminal VGL of the gate driving circuit, the first reference voltage output terminal VREF1, or the second reference voltage output terminal VREF2 can avoid additional disposition of a reset power supply, reduce the manufacturing cost, and simplify the complexity of the pixel driving circuit.

Optionally, as shown in FIGS. 15 and 16, if multiple light-emitting elements 107 are provided, the second power supply PVEE also serves as the reset power supply. If one light-emitting element 107 is provided, the low-voltage signal terminal VGL of the gate driving circuit also serves as the reset power supply.

As shown in FIG. 16, when multiple light-emitting elements are disposed in the light-emitting unit 107, for example, six light-emitting elements are disposed in the light-emitting unit 107, the voltage between the first power supply PVDD and the second power supply PVEE is relatively high, and the absolute value of the second power supply PVEE is relatively high, for example, the second power supply PVEE may be −14V. The absolute value of the second power supply PVEE is larger than the absolute value of the low-voltage signal terminal VGL of the gate driving circuit. The second power supply PVEE also serves as the reset power supply. The second power source PVEE can further reduce the possibility that the light-emitting element in the light-emitting unit 107 is turned on, and no additional wiring is required to adopt the low-voltage signal terminal VGL in the gate driving circuit. As shown in FIG. 15, when only one light-emitting element is disposed in the light-emitting unit 107, the low-voltage signal terminal VGL of the gate driving circuit also serves as the reset power supply and is configured to provide the reset power supply for the control terminal of the drive unit 104. Moreover, a small reset voltage enables the fifth transistor T5 to easily reset the first node N1, thereby effectively avoiding the occurrence of the screen flicker phenomenon of the display panel.

Figure 18:
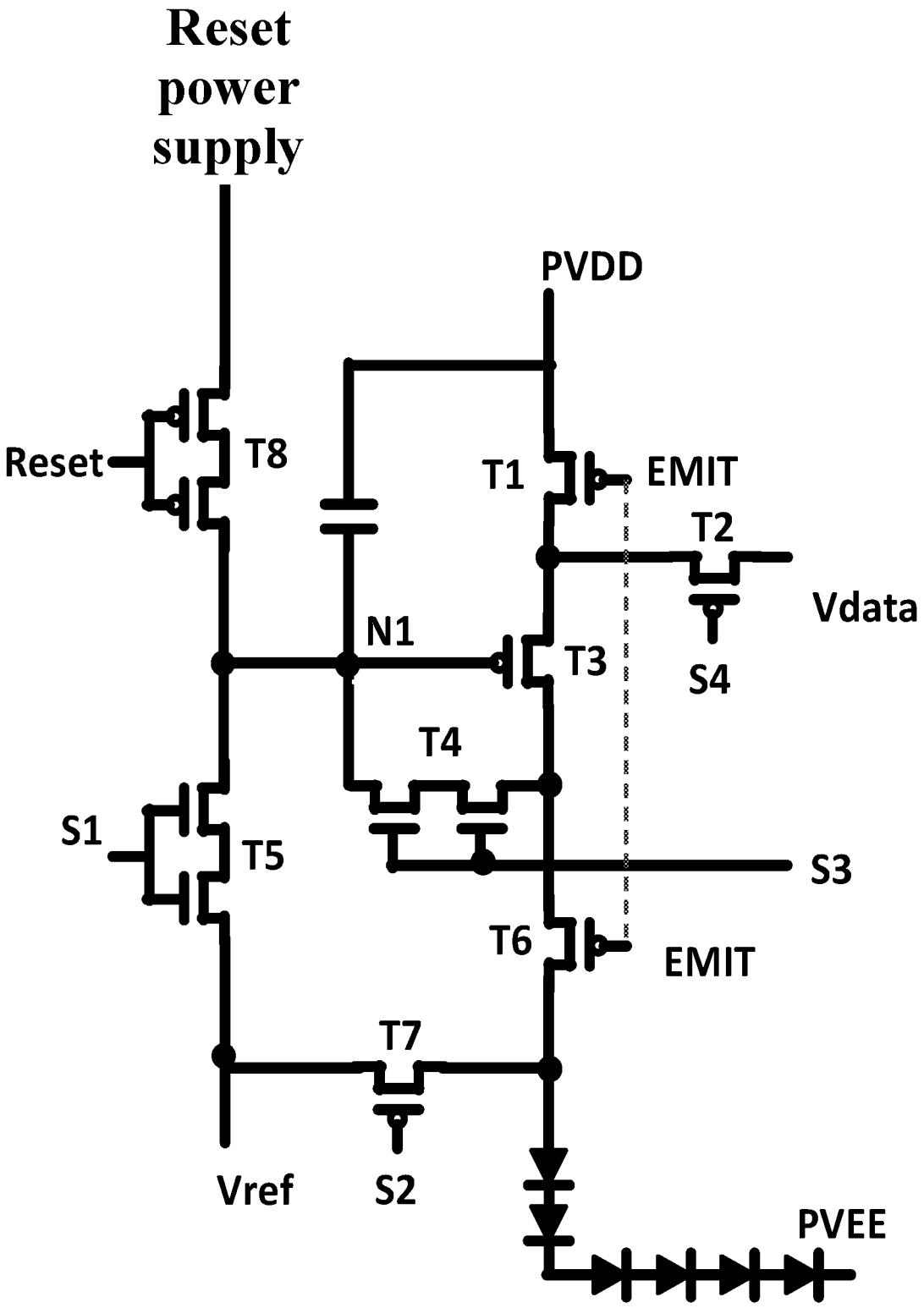
FIG. 18 is a diagram illustrating the structure of another pixel driving circuit according to an embodiment of the present disclosure.
Figure 19:
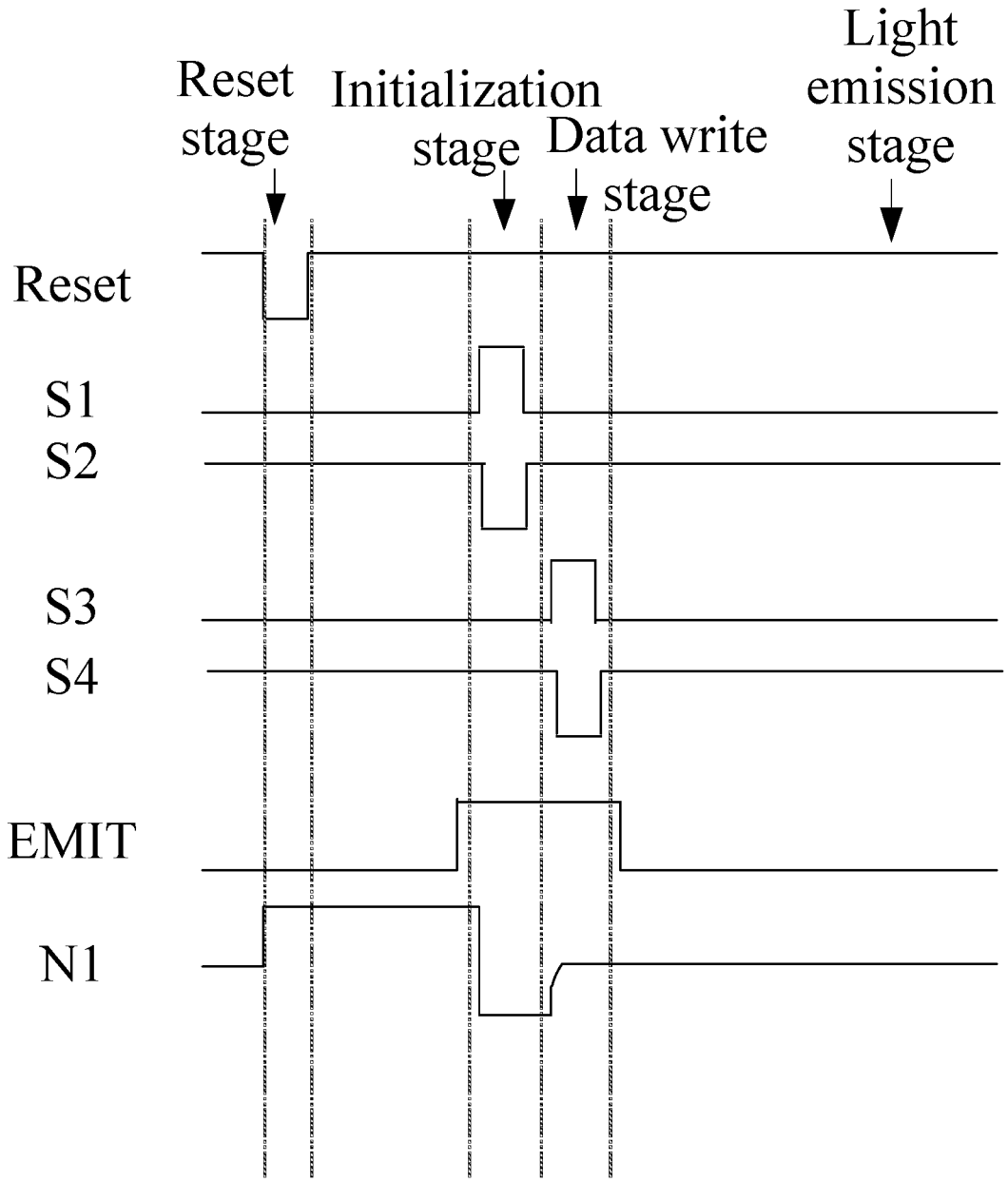
FIG. 19 is a timing diagram of another pixel driving circuit according to an embodiment of the present disclosure.

Optionally, FIG. 18 is a diagram illustrating the structure of another pixel driving circuit according to an embodiment of the present disclosure. FIG. 19 is a timing diagram of another pixel driving circuit according to an embodiment of the present disclosure. As shown in FIGS. 18 and 19, the first transistor T1, the second transistor T2, the third transistor T3, the sixth transistor T6, the seventh transistor T7, and the eighth transistor T8 are each a p-type transistor. The fourth transistor T4 and fifth transistor T5 are each an n-type transistor. The timing of the signal output by the first scan signal line and the timing of the signal output by the second scan signal line are the same, and the direction of the signal output by the first scan signal line and the direction of the signal output by the second scan signal line are opposite. The timing of the signal output by the third scan signal line and the timing of the signal output by the fourth scan signal line are the same, and the direction of the signal output by the third scan signal line and the direction of the signal output by the fourth scan signal line are opposite.

The first transistor T1, the second transistor T2, the third transistor T3, the sixth transistor T6, the seventh transistor T7, and the eighth transistor T8 are each a p-type transistor and are prepared by using an LTPS process. Since the fifth transistor T5 is an n-type transistor, and the seventh transistor T7 is a p-type transistor, in the initialization stage, the fifth transistor T5 and the seventh transistor T7 may be turned on at the same time. At this time, the first scan signal line connected to the control terminal of the fifth transistor T5 is at a high level, and the second scan signal line connected to the control terminal of the seventh transistor T7 is at a low level. In the non-initialization stage, the fifth transistor T5 and the seventh transistor T7 may be turned off at the same time. At this time, the first scan signal line connected to the control terminal of the fifth transistor T5 is at a low level, and the second scan signal line connected to the control terminal of the seventh transistor T7 is at a high level. In this manner, the timing of the signal output by the first scan signal line and the timing of the signal output by the second scan signal line are controlled to be the same, and the direction of the signal output by the first scan signal line and the direction of the signal output by the second scan signal line are controlled to be opposite. Then it is ensured that the fifth transistor T5 and the seventh transistor T7 can be turned on or off at the same time. Since the second transistor T2 is an n-type transistor, and the fourth transistor T4 is a p-type transistor, in the initialization stage, the second transistor T2 and the fourth transistor T4 may be turned on at the same time. At this time, the fourth scan signal line connected to the control terminal of the second transistor T2 is at a low level, and the third scan signal line connected to the control terminal of the fourth transistor T4 is at a high level. In the non-initialization stage, the second transistor T2 and the fourth transistor T4 may be turned off at the same time. At this time, the fourth scan signal line connected to the control terminal of the second transistor T2 is at a high level, and the third scan signal line connected to the control terminal of the fourth transistor T4 is at a low level. In this manner, the timing of the signal output by the third scan signal line and the timing of the signal output by the fourth scan signal line are controlled to be the same, and the direction of the signal output by the third scan signal line and the direction of the signal output by the fourth scan signal line are controlled to be opposite. Then it is ensured that the second transistor T2 and the fourth transistor T4 can be turned on or off at the same time. The fourth transistor T4 and the fifth transistor T5 are converted into double-gate n-type transistors. In this manner, the current leakage phenomenon in the pixel driving circuit can be effectively avoided, and the stability of the potential of the first node N1 is ensured. Moreover, the normal working of the pixel driving circuit is ensured, and the display effect of the display panel is ensured.

Figure 20:
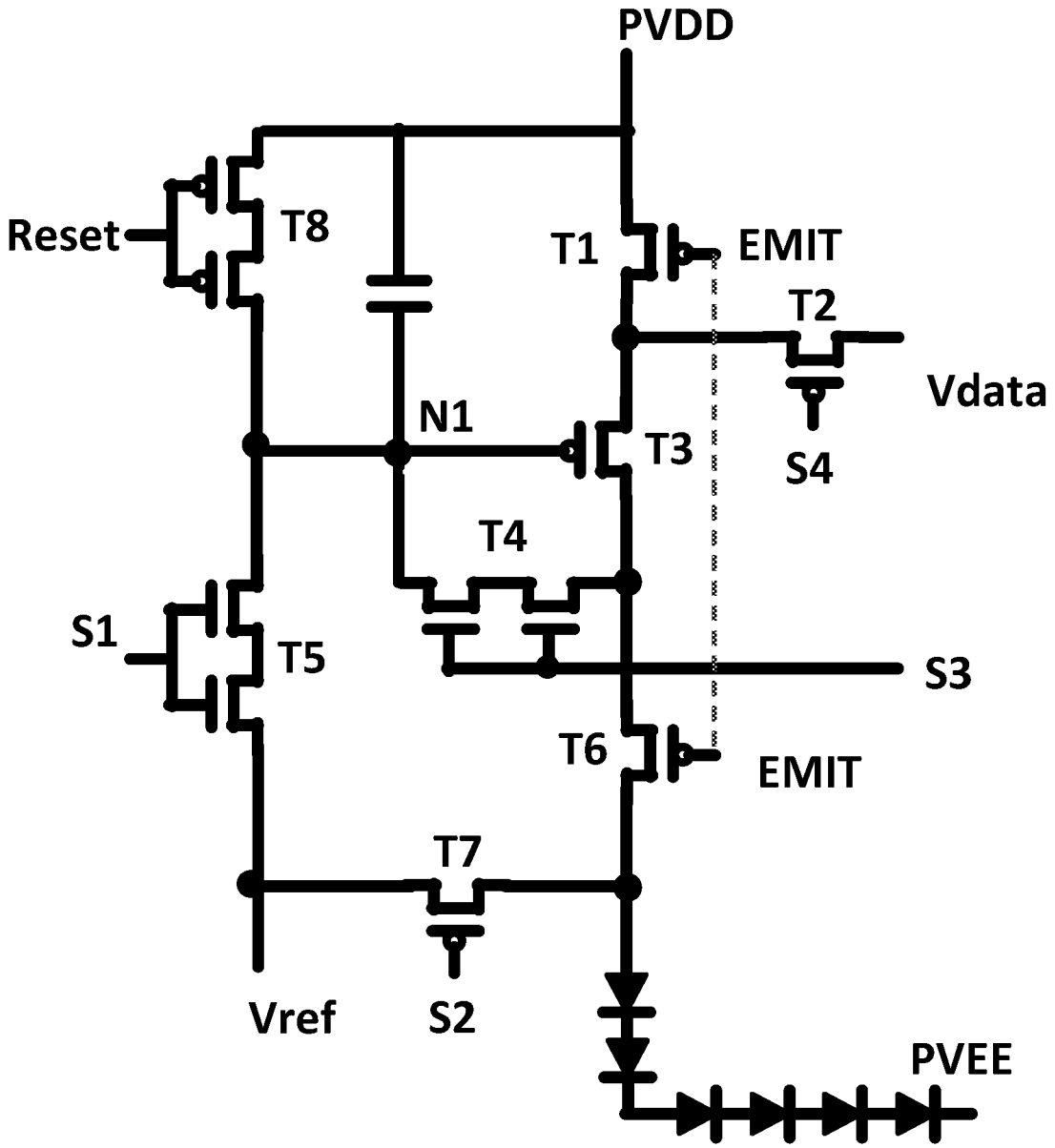
FIG. 20 is a diagram illustrating the structure of another pixel driving circuit according to an embodiment of the present disclosure.
Figure 21:
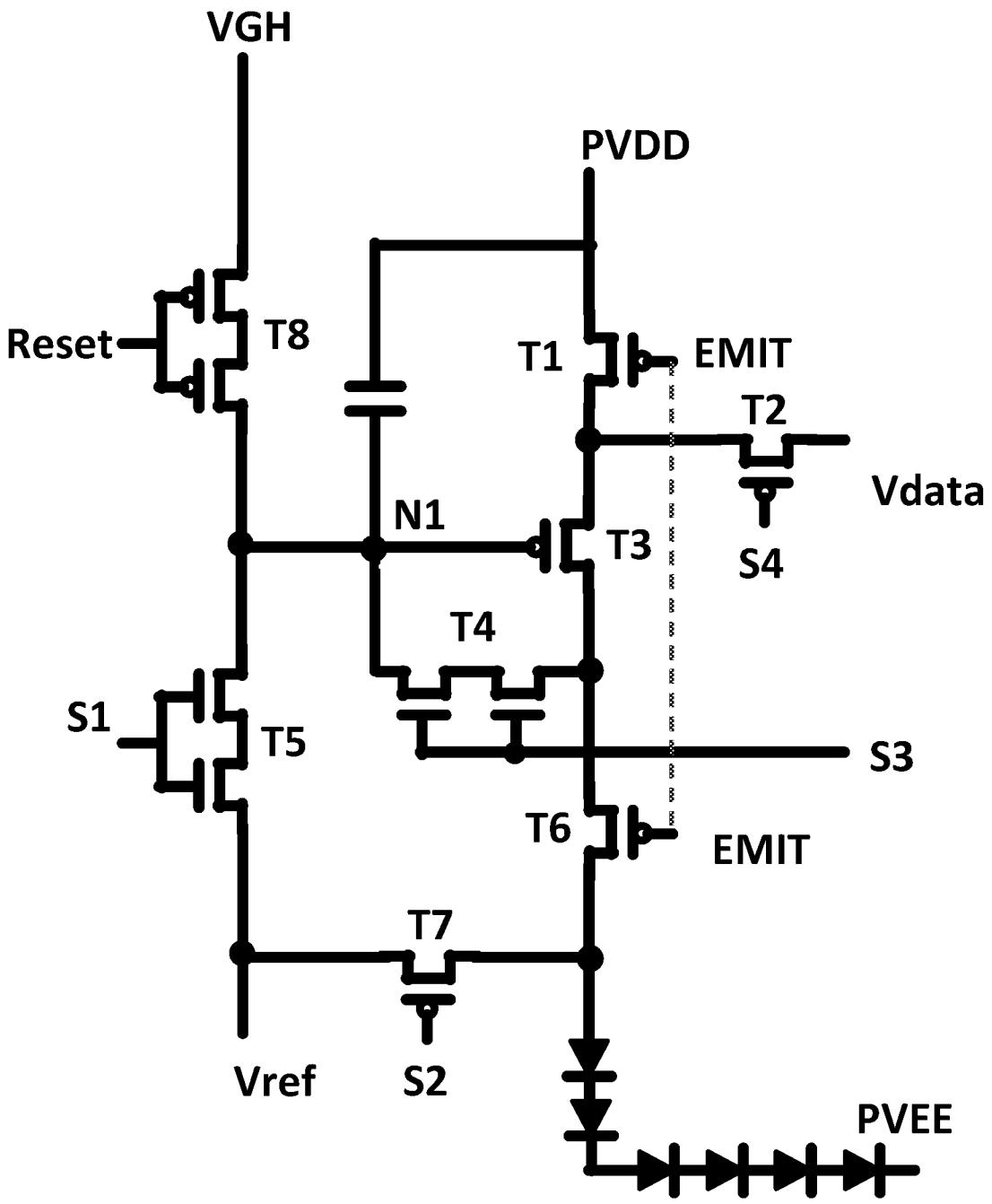
FIG. 21 is a diagram illustrating the structure of another pixel driving circuit according to an embodiment of the present disclosure.

Optionally, FIG. 20 is a diagram illustrating the structure of another pixel driving circuit according to an embodiment of the present disclosure. FIG. 21 is a diagram illustrating the structure of another pixel driving circuit according to an embodiment of the present disclosure. As shown in FIGS. 20 and 21, the first power supply PVDD also serves as the reset power supply, or the high-voltage signal terminal VGH of the gate driving circuit also serves as the reset power supply.

The third transistor T3 is a p-type transistor. The third transistor T3 is turned on at a high level and is turned off at a low level. Since in the power-on reset stage, to prevent the third transistor T3 from being abnormally turned on, at this time, it is necessary to write a low level to the control terminal of the third transistor T3. As shown in FIG. 20, the first power supply PVDD is generally a high-level signal. Thus, the first power supply PVDD may also serve as the reset power supply. Alternatively, as shown in FIG. 21, the high-voltage signal terminal VGH of the gate driving circuit outputs a high-level signal. The high-voltage signal terminal VGH of the gate driving circuit also serves as the reset power supply. The multiplexing of the first power supply PVDD or the high-voltage signal terminal VGH of the gate driving circuit can avoid additional disposition of a reset power supply, reduce the manufacturing cost, and simplify the complexity of the pixel driving circuit. Similarly, if multiple light-emitting elements 107 are provided, the high-voltage signal terminal VGH of the gate driving circuit also serves as the reset power supply. If one light-emitting element 107 is provided, the first power supply PVDD also serves as the reset power supply.

Figure 22:
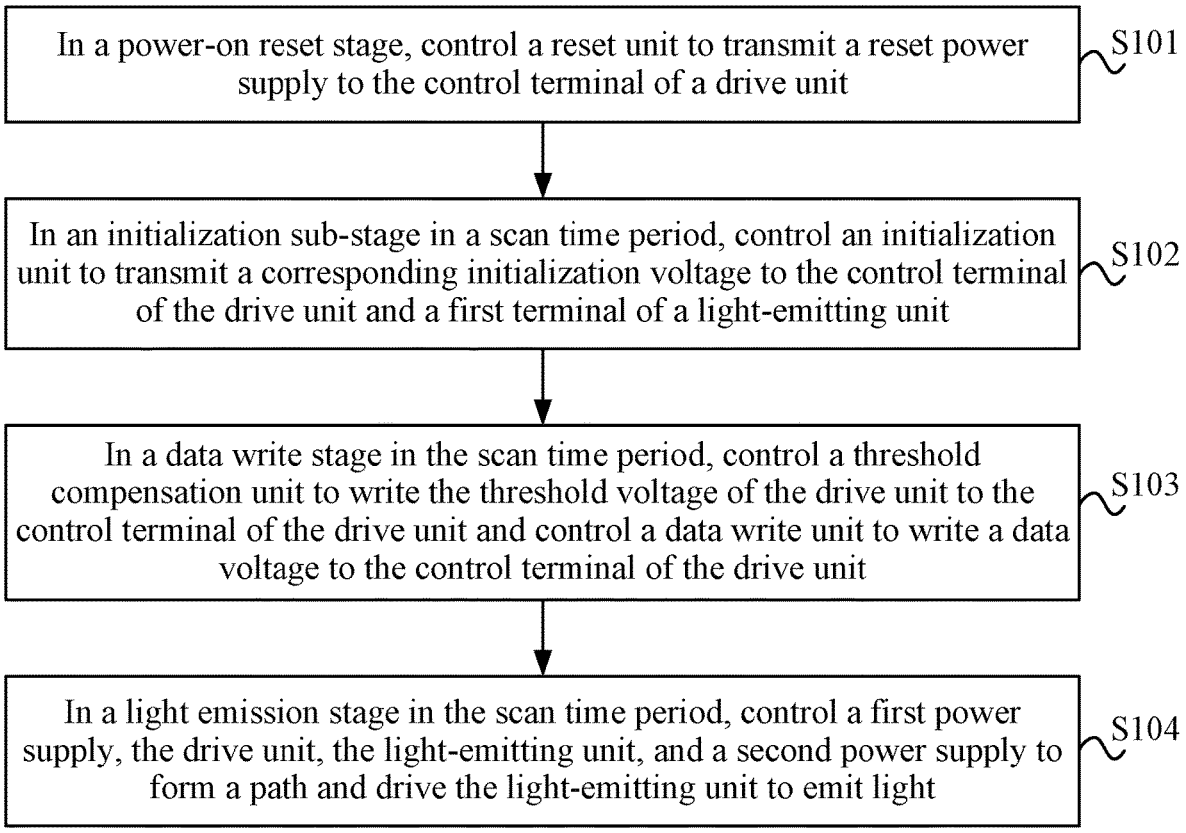
FIG. 22 is a flowchart of a driving method of a pixel circuit according to an embodiment of the present disclosure.

FIG. 22 is a flowchart of a driving method of a pixel circuit according to an embodiment of the present disclosure. The driving method of a pixel circuit is applied by the pixel circuit according to any one of the preceding embodiments. The method includes the steps below.

In S101, in the power-on reset stage, the reset unit is controlled to transmit the reset power supply to the control terminal of the drive unit.

The reset unit writes the signal output by the reset power supply to the control terminal of the drive unit before the scan time period, so that in the power-on reset stage, the drive unit is in the off state. In this manner, there is no abnormally turn-on phenomenon, thereby ensuring the normal display of the display panel, and avoiding the occurrence of the screen flicker phenomenon.

In S102, in the initialization sub-stage in the scan time period, the initialization unit is controlled to transmit the corresponding initialization voltage to the control terminal of the drive unit and the first terminal of the light-emitting unit.

The control terminal of the drive unit is initialized before the data write stage to clear the gate potential of the transistor in the drive unit in the previous frame. In this manner, the data voltage in the data write stage is written. Thus, the display effect of the display panel is ensured.

In S103, in the data write stage in the scan time period, the threshold compensation unit is controlled to write the threshold voltage of the drive unit to the control terminal of the drive unit, and the data write unit is controlled to write the data voltage to the control terminal of the drive unit.

In the data write stage, the threshold compensation unit captures the threshold voltage of the drive unit and writes the threshold voltage to the control terminal of the drive unit, thereby implementing the compensation of the threshold voltage. At the same time, the data write unit writes the data voltage to the control terminal of the drive unit, thereby ensuring the display uniformity of the display panel.

In S104, in the light emission stage in the scan time period, the first power supply, the drive unit, the light-emitting unit, and the second power supply are controlled to form a path, and the light-emitting unit is driven to emit light.

In the light emission stage, the drive unit generates a driving circuit according to the data voltage, and the light-emitting unit emits light in response to a drive current, thereby implementing the to-be-displayed brightness.

In this embodiment of the present disclosure, a power-on reset operation is performed on the drive unit before the scan time period, so that the drive unit may not be abnormally turned on in a non-scan time period. In this manner, the light-emitting unit may not be abnormally lighted, and the screen flicker phenomenon of the display panel may not be caused. Thus, the display effect of the display panel is ensured.

Optionally, after each power-on operation, the power-on reset stage is executed once, and the scan time period is executed multiple times. For example, the scan time period may be cyclically executed merely after the power-on reset stage during the power-on period to effectively save scan time and increase a refresh frequency. After each power-on operation is executed by the pixel circuit, the operation of the power-on reset stage is executed before the scan time period, so that the drive unit may not be abnormally turned on before the scan time period. In this manner, the change in the display brightness of the light-emitting unit in the non-display stage may not be occurs, and the normal display effect of the display panel may not be affected. Alternatively, before each scan time period, the preceding power-on reset stage may be performed to further improve the display effect of the display panel.

Figure 23:
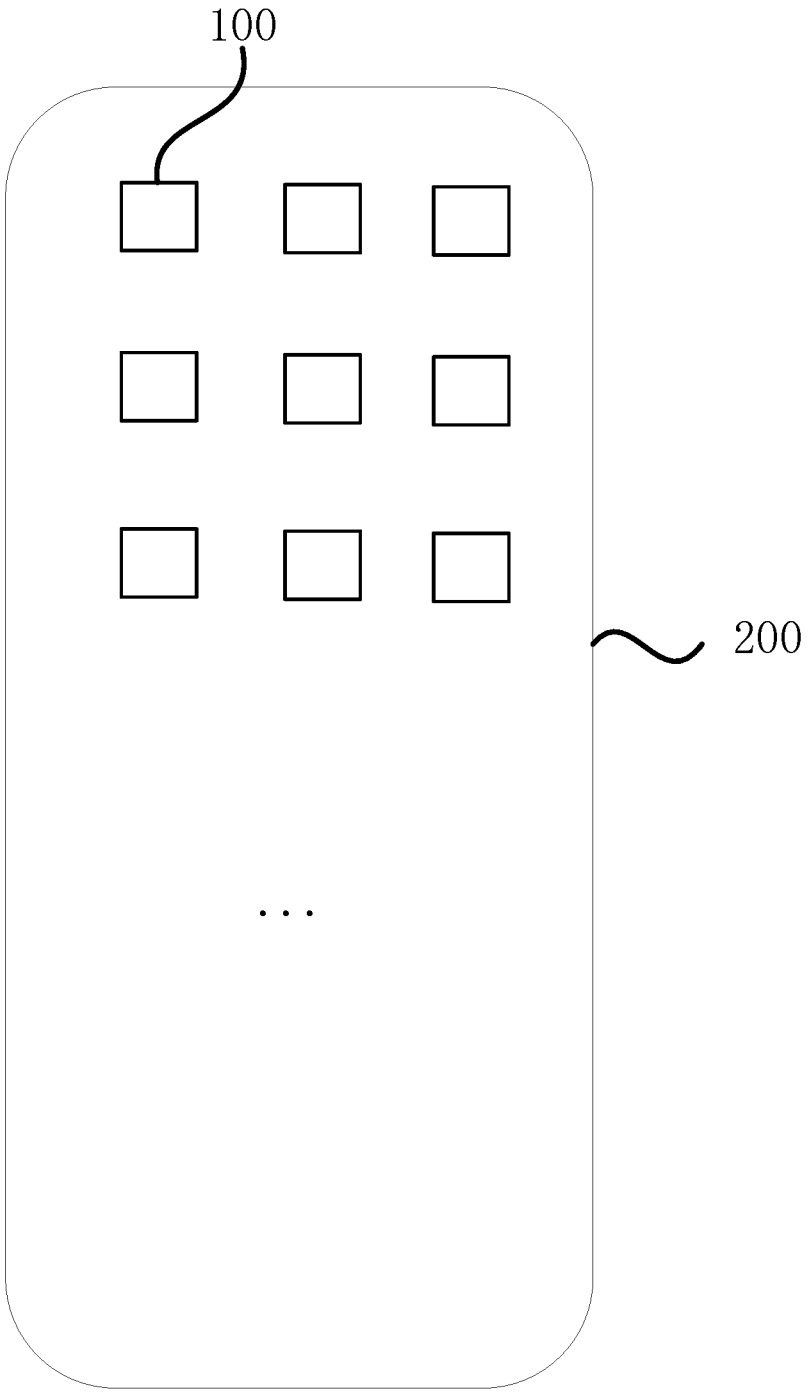
FIG. 23 is a diagram illustrating the structure of a light-emitting panel according to an embodiment of the present disclosure.

Based on the same inventive concept, an embodiment of the present disclosure provides a light-emitting panel. FIG. 23 is a diagram illustrating the structure of a light-emitting panel according to an embodiment of the present disclosure. The light-emitting panel 200 includes the pixel driving circuit 100 according to any one of the preceding embodiments. The light-emitting panel includes multiple pixel driving circuits arranged in an array provided by embodiments of the present disclosure. Accordingly, the light-emitting panel also has the beneficial effects of the pixel driving circuit provided by the embodiments of the present disclosure, and the same portions can be understood with reference to the preceding description and are not described in detail hereinafter. As described in the preceding embodiments, the light-emitting panel may be the display panel. The pixel circuit is configured to drive a corresponding light-emitting element for display. The light-emitting element may be a Micro LED or a Mini LED. The light-emitting panel may also be a backlight panel. At this time, the light-emitting unit includes multiple light-emitting elements. A light-emitting element may be a Mini LED to implement a backlight requirement. The backlight display panel may be combined with a liquid-crystal panel to form a display panel. The backlight panel is configured to provide backlight for the liquid-crystal panel. At this time, since the reset unit is adopted in the pixel driving circuit of the backlight panel to control the drive unit during the power-on period, so that the drive unit is always in the off state during the power-on period. In this manner, the occurrence of the screen flicker phenomenon of the backlight panel is avoided, and the display effect of the backlight panel is ensured.

Figure 24:
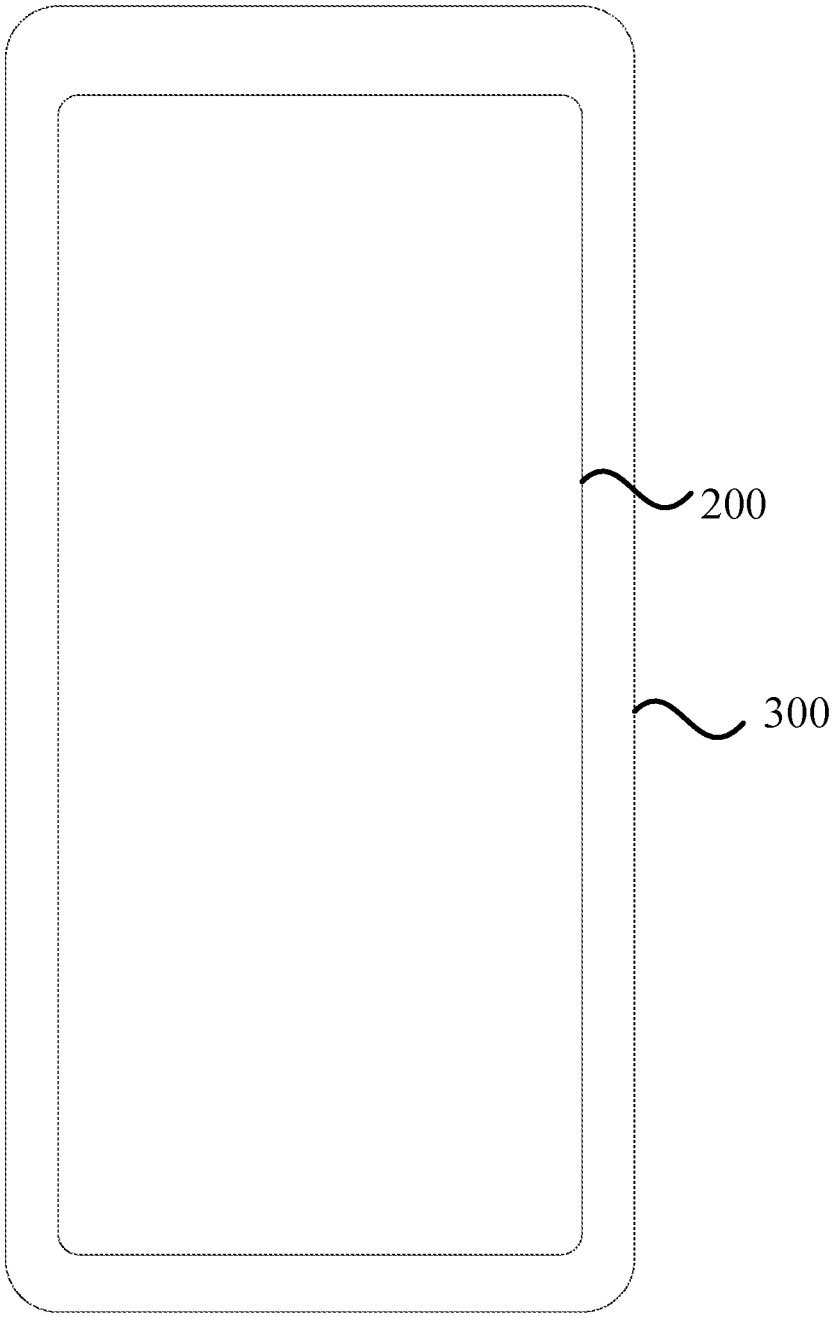
FIG. 24 is a diagram illustrating the structure of a display device according to an embodiment of the present disclosure.

FIG. 24 is a view illustrating the structure of a display device according to an embodiment of the present disclosure. As shown in FIG. 24, the display device 300 includes the light-emitting panel 200 according to the preceding embodiment.

It is to be noted that since the display device provided by this embodiment has the same or corresponding beneficial effects as the display panel according to the preceding embodiment, the details are not repeated here. The display device 300 provided by this embodiment of the present disclosure may be a phone shown in FIG. 24 or may be any electronic product having a display function, including but not limited to televisions, laptops, desktop displays, tablet computers, digital cameras, smart bracelets, smart glasses, in-vehicle displays, medical equipment, industry-controlling equipment, and touch interactive terminals. This is not specially limited in this embodiment of the present disclosure.

It is to be noted that the preceding are only preferred embodiments of the present disclosure and the technical principles used therein. It is to be understood by those skilled in the art that the present disclosure is not limited to the embodiments described herein. For those skilled in the art, various apparent modifications, adaptations, and substitutions can be made without departing from the scope of the present disclosure. Therefore, while the present disclosure is described in detail in connection with the preceding embodiments, the present disclosure is not limited to the preceding embodiments and may include equivalent embodiments without departing from the concept of the present disclosure. The scope of the present disclosure is determined by the scope of the appended claims.

What is claimed is:

1. A pixel driving circuit, comprising a reset unit, a storage unit, an initialization unit, a drive unit, a threshold compensation unit, and a data write unit, wherein a first terminal of the drive unit is configured to input a signal output by a first power supply, and a second terminal of the drive unit is configured to provide a light-emitting drive signal for a light-emitting unit; the storage unit is connected between a control terminal of the drive unit and the first terminal of the drive unit; and the threshold compensation unit is connected between the control terminal of the drive unit and the second terminal of the drive unit;

the data write unit is connected to the first terminal of the drive unit and configured to transmit a data voltage to the drive unit; the initialization unit is connected to the control terminal of the drive unit and a first terminal of the light-emitting unit and configured to transmit a corresponding initialization voltage to the control terminal of the drive unit and the first terminal of the light-emitting unit; and a first terminal of the reset unit is configured to input a signal output by a reset power supply; and a second terminal of the reset unit is connected to the control terminal of the drive unit and configured to provide the reset power supply for the control terminal of the drive unit during a power-on period.

2. The pixel driving circuit according to claim 1, further comprising: a first light emission control unit and a second light emission control unit, wherein the first light emission control unit is connected between the first power supply and the first terminal of the drive unit; and the second light emission control unit is connected between the second terminal of the drive unit and the first terminal of the light-emitting unit, and a second terminal of the light-emitting unit is connected to a second power supply.

3. The pixel driving circuit according to claim 2, wherein the initialization unit comprises a first initialization unit and a second initialization unit, wherein the first initialization unit is connected between a first reference voltage output terminal and the control terminal of the drive unit and configured to provide a first initialization voltage for the drive unit; and the second initialization unit is connected between a second reference voltage output terminal and the first terminal of the light-emitting unit and configured to provide a second initialization voltage for the light-emitting unit.

4. The pixel driving circuit according to claim 3, wherein the storage unit comprises a first capacitor; the first light emission control unit comprises a first transistor; the data write unit comprises a second transistor; the drive unit comprises a third transistor; the threshold compensation unit comprises a fourth transistor; the first initialization unit comprises a fifth transistor; the second light emission control unit comprises a sixth transistor; the second initialization unit comprises a seventh transistor; and the reset unit comprises an eighth transistor;

a control terminal of the third transistor is connected to a second terminal of the eighth transistor, a second terminal of the fifth transistor, and a first terminal of the fourth transistor respectively; a first terminal of the third transistor is connected to a second terminal of the first transistor; a first terminal of the first transistor is connected to the first power supply; a second terminal of the third transistor is connected to a second terminal of the fourth transistor, and a first terminal of the sixth transistor respectively; and a second terminal of the sixth transistor is connected to the first terminal of the light-emitting unit;

a first terminal of the eighth transistor is connected to the reset power supply; a first terminal of the fifth transistor is connected to the first reference voltage output terminal; a first terminal of the second transistor is connected to a data signal line; a second terminal of the second transistor is connected to the first terminal of the third transistor; a first terminal of the seventh transistor is connected to the second reference voltage output terminal; and a second terminal of the seventh transistor is connected to the first terminal of the light-emitting unit; and a control terminal of the first transistor and a control terminal of the sixth transistor are connected to a light emission control signal line; a control terminal of the fifth transistor is connected to a first scan signal line; a control terminal of the seventh transistor is connected to a second scan signal line; a control terminal of the fourth transistor is connected to a third scan signal line; and a control terminal of the second transistor is connected to a fourth scan signal line.

5. The pixel driving circuit according to claim 4, wherein the first scan signal line, the second scan signal line, the third scan signal line, and the fourth scan signal line are configured to implement the following:

in a power-on reset stage, driving the first transistor, the sixth transistor, and the eighth transistor to turn on; and driving the second transistor, the third transistor, the fourth transistor, the fifth transistor, and the seventh transistor to turn off;

in an initialization sub-stage in a scan time period, driving the fifth transistor and the seventh transistor to turn on; and driving the first transistor, the second transistor, the fourth transistor, the third transistor, the sixth transistor, and the eighth transistor to turn off;

in a data write stage in the scan time period, driving the second transistor, the third transistor, and the fourth transistor to turn on; and driving the first transistor, the fifth transistor, the sixth transistor, the seventh transistor, and the eighth transistor to turn off; and in a light emission stage in the scan time period, driving the first transistor, the third transistor, and the sixth transistor to turn on; and driving the second transistor, the fourth transistor, the fifth transistor, the seventh transistor, and the eighth transistor to turn off.

6. The pixel driving circuit according to claim 4, wherein the first transistor, the second transistor, the third transistor, the fourth transistor, the fifth transistor, the sixth transistor, the seventh transistor, and the eighth transistor are each a p-type transistor; and the first scan signal line also serves as the second scan signal line; and the third scan signal line also serves as the fourth scan signal line.

7. The pixel driving circuit according to claim 6, wherein the first power supply also serves as the reset power supply; or a high-voltage signal terminal of a gate driving circuit also serves as the reset power supply.

8. The pixel driving circuit according to claim 7, wherein in a case where a plurality of light-emitting elements are provided, the high-voltage signal terminal of the gate driving circuit also serves as the reset power supply; and in a case where one light-emitting element is provided, the first power supply also serves as the reset power supply.

9. The pixel driving circuit according to claim 4, wherein the first transistor, the second transistor, the third transistor, the fourth transistor, the fifth transistor, the sixth transistor, the seventh transistor, and the eighth transistor are each an n-type transistor; and the first scan signal line also serves as the second scan signal line; and the third scan signal line also serves as the fourth scan signal line.

10. The pixel driving circuit according to claim 9, wherein the second power supply also serves as the reset power supply; or a low-voltage signal terminal of a gate driving circuit also serves as the reset power supply; or the first reference voltage output terminal or the second reference voltage output terminal also serves as the reset power supply.

11. The pixel driving circuit according to claim 10, wherein in a case where a plurality of light-emitting elements are provided, the second power supply also serves as the reset power supply; and in a case where one light-emitting element is provided, the low-voltage signal terminal of the gate driving circuit also serves as the reset power supply.

12. The pixel driving circuit according to claim 4, wherein the first transistor, the second transistor, the third transistor, the sixth transistor, the seventh transistor, and the eighth transistor are each a p-type transistor; and the fourth transistor and fifth transistor are each an n-type transistor; and timing of a signal output by the first scan signal line and timing of a signal output by the second scan signal line are the same, and a direction of the signal output by the first scan signal line and a direction of the signal output by the second scan signal line are opposite; and timing of a signal output by the third scan signal line and timing of a signal output by the fourth scan signal line are the same, and a direction of the signal output by the third scan signal line and a direction of the signal output by the fourth scan signal line are opposite.

13. The pixel driving circuit according to claim 12, wherein the first power supply also serves as the reset power supply; or a high-voltage signal terminal of a gate driving circuit also serves as the reset power supply.

14. The pixel driving circuit according to claim 1, wherein the light-emitting unit comprises a plurality of micro LEDs connected in parallel.

15. The pixel driving circuit according to claim 1, wherein the light-emitting unit comprises a plurality of micro LEDs connected in series.

16. The pixel driving circuit according to claim 1, wherein a control terminal of the reset unit is connected to a reset scan signal output terminal; and the reset scan signal output terminal also serves as a reset signal output terminal of a gate driving circuit.

17. A driving method of a pixel circuit, the method being applied by the pixel circuit according to claim 1 and comprising:

in a power-on reset stage, controlling the reset unit to transmit the reset power supply to the control terminal of the drive unit;

in an initialization sub-stage in a scan time period, controlling the initialization unit to transmit the corresponding initialization voltage to the control terminal of the drive unit and the first terminal of the light-emitting unit;

in a data write stage in the scan time period, controlling the threshold compensation unit to write a threshold voltage of the drive unit to the control terminal of the drive unit and controlling the data write unit to write the data voltage to the control terminal of the drive unit; and in a light emission stage in the scan time period, controlling the first power supply, the drive unit, the light-emitting unit, and a second power supply to form a path and driving the light-emitting unit to emit light.

18. The driving method of a pixel circuit according to claim 17, wherein after each power-on operation, the power-on reset stage is executed once, and the scan time period is executed a plurality of times.

19. A light-emitting panel, comprising a pixel driving circuit which comprises a reset unit, a storage unit, an initialization unit, a drive unit, a threshold compensation unit, and a data write unit, wherein a first terminal of the drive unit is configured to input a signal output by a first power supply, and a second terminal of the drive unit is configured to provide a light-emitting drive signal for a light-emitting unit; the storage unit is connected between a control terminal of the drive unit and the first terminal of the drive unit; and the threshold compensation unit is connected between the control terminal of the drive unit and the second terminal of the drive unit;

the data write unit is connected to the first terminal of the drive unit and configured to transmit a data voltage to the drive unit; the initialization unit is connected to the control terminal of the drive unit and a first terminal of the light-emitting unit and configured to transmit a corresponding initialization voltage to the control terminal of the drive unit and the first terminal of the light-emitting unit; and a first terminal of the reset unit is configured to input a signal output by a reset power supply; and a second terminal of the reset unit is connected to the control terminal of the drive unit and configured to provide the reset power supply for the control terminal of the drive unit during a power-on period.

20. A display device, comprising a light-emitting panel which comprising a pixel driving circuit, wherein the pixel driving circuit comprises a reset unit, a storage unit, an initialization unit, a drive unit, a threshold compensation unit, and a data write unit, wherein a first terminal of the drive unit is configured to input a signal output by a first power supply, and a second terminal of the drive unit is configured to provide a light-emitting drive signal for a light-emitting unit; the storage unit is connected between a control terminal of the drive unit and the first terminal of the drive unit; and the threshold compensation unit is connected between the control terminal of the drive unit and the second terminal of the drive unit;

the data write unit is connected to the first terminal of the drive unit and configured to transmit a data voltage to the drive unit; the initialization unit is connected to the control terminal of the drive unit and a first terminal of the light-emitting unit and configured to transmit a corresponding initialization voltage to the control terminal of the drive unit and the first terminal of the light-emitting unit; and a first terminal of the reset unit is configured to input a signal output by a reset power supply; and a second terminal of the reset unit is connected to the control terminal of the drive unit and configured to provide the reset power supply for the control terminal of the drive unit during a power-on period.

* * * * *